US007980421B2

(12) United States Patent
Ophardt et al.

(10) Patent No.: US 7,980,421 B2
(45) **Date of Patent: *Jul. 19, 2011**

(54) OPTICALLY KEYED DISPENSER

(75) Inventors: Heiner Ophardt, Vineland (CA); Andrew Jones, Smithville (CA)

(73) Assignee: Gotohti.com Inc., Beamsville Ontario (CA)

( * ) Notice: Subject to any disclaimer, the term of this patent is extended or adjusted under 35 U.S.C. 154(b) by 398 days.

This patent is subject to a terminal disclaimer.

(21) Appl. No.: 12/155,763

(22) Filed: Jun. 9, 2008

(65) Prior Publication Data

US 2009/0008408 A1 Jan. 8, 2009

Related U.S. Application Data

(63) Continuation-in-part of application No. 11/881,753, filed on Jul. 30, 2007.

(30) Foreign Application Priority Data

Jun. 18, 2007 (CA) ..... 2592186
Aug. 13, 2007 (CA) ..... 2597190
Jun. 5, 2008 (CA) ..... 2633564

(51) Int. Cl.
*G01F 11/00* (2006.01)

(52) U.S. Cl. ..... 222/1; 222/52; 222/63; 222/181.1; 222/181.3; 222/183; 222/325; 250/221; 250/372

(58) Field of Classification Search ..... 222/1, 52, 222/63, 181.1, 183, 181.3, 325, 113, 333, 222/327, 372, 383.1; 250/221, 372
See application file for complete search history.

(56) References Cited

U.S. PATENT DOCUMENTS

| | | | | |
|---|---|---|---|---|
| 4,711,368 | A | 12/1987 | Simons | |
| 4,722,372 | A * | 2/1988 | Hoffman et al. | 141/98 |
| 5,373,970 | A | 12/1994 | Ophardt | |
| 5,851,108 | A * | 12/1998 | Clymer et al. | 417/44.1 |
| 5,979,500 | A * | 11/1999 | Jahrling et al. | 137/624.12 |
| 6,206,238 | B1 | 3/2001 | Ophardt | |
| 6,607,103 | B2 * | 8/2003 | Gerenraich et al. | 222/183 |
| 7,247,140 | B2 * | 7/2007 | Ophardt | 600/437 |
| 7,451,894 | B2 * | 11/2008 | Ophardt | 222/52 |
| 7,621,426 | B2 * | 11/2009 | Reynolds et al. | 222/325 |
| 2005/0127090 | A1 | 6/2005 | Sayers et al. | |
| 2006/0124662 | A1 | 6/2006 | Reynolds | |

FOREIGN PATENT DOCUMENTS

DE 20 2004 013 101 U1 12/2004

OTHER PUBLICATIONS

English Translation of DE 20 2004 013 101.

* cited by examiner

*Primary Examiner* — Frederick C. Nicolas
(74) *Attorney, Agent, or Firm* — Riches, McKenzie & Herbert LLP

(57) ABSTRACT

A method of controlling operation of a mechanism, preferably a dispenser, having a removable component comprises measuring electromagnetic radiation passing through a waveguide carrying at least in part on the removable component and permitting operation of the mechanism only when the measured electromagnetic radiation corresponds with one or more pre-selected parameters. Preferably, the method involves directing emitted electromagnetic radiation with pre-selected input parameters selected from a plurality of input parameters.

18 Claims, 18 Drawing Sheets

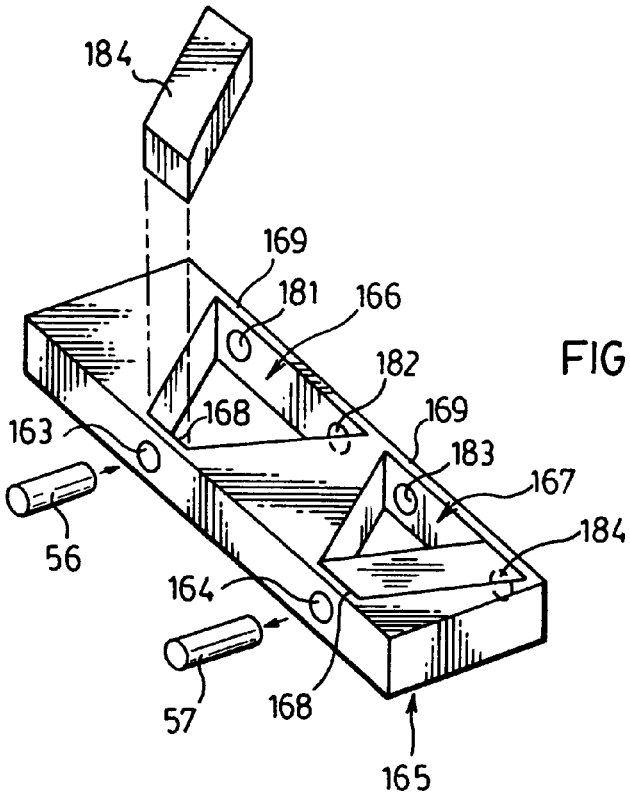
FIG. 15.
FIG. 16.
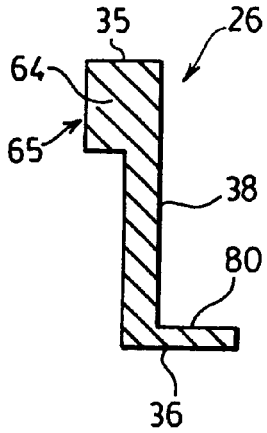
FIG. 17.
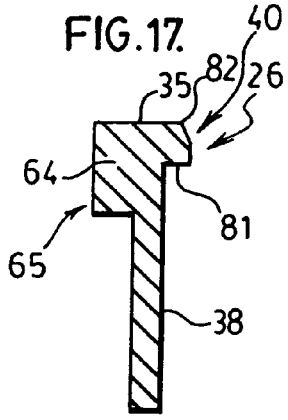
FIG. 18.
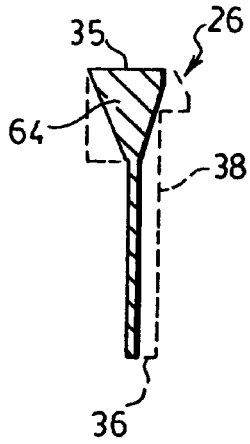

FIG. 19
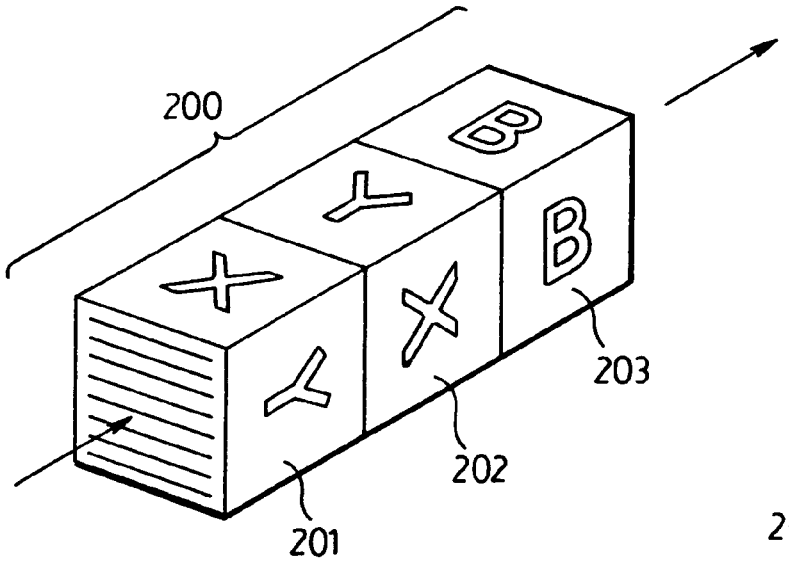
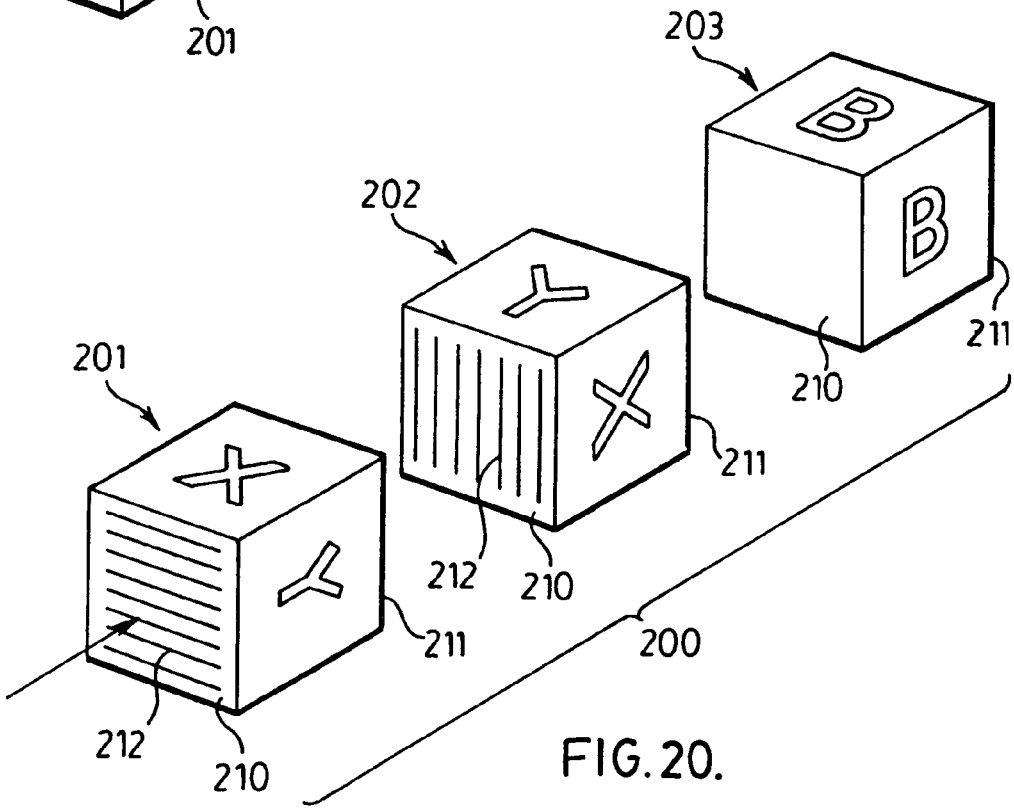
FIG. 20.

FIG. 25.
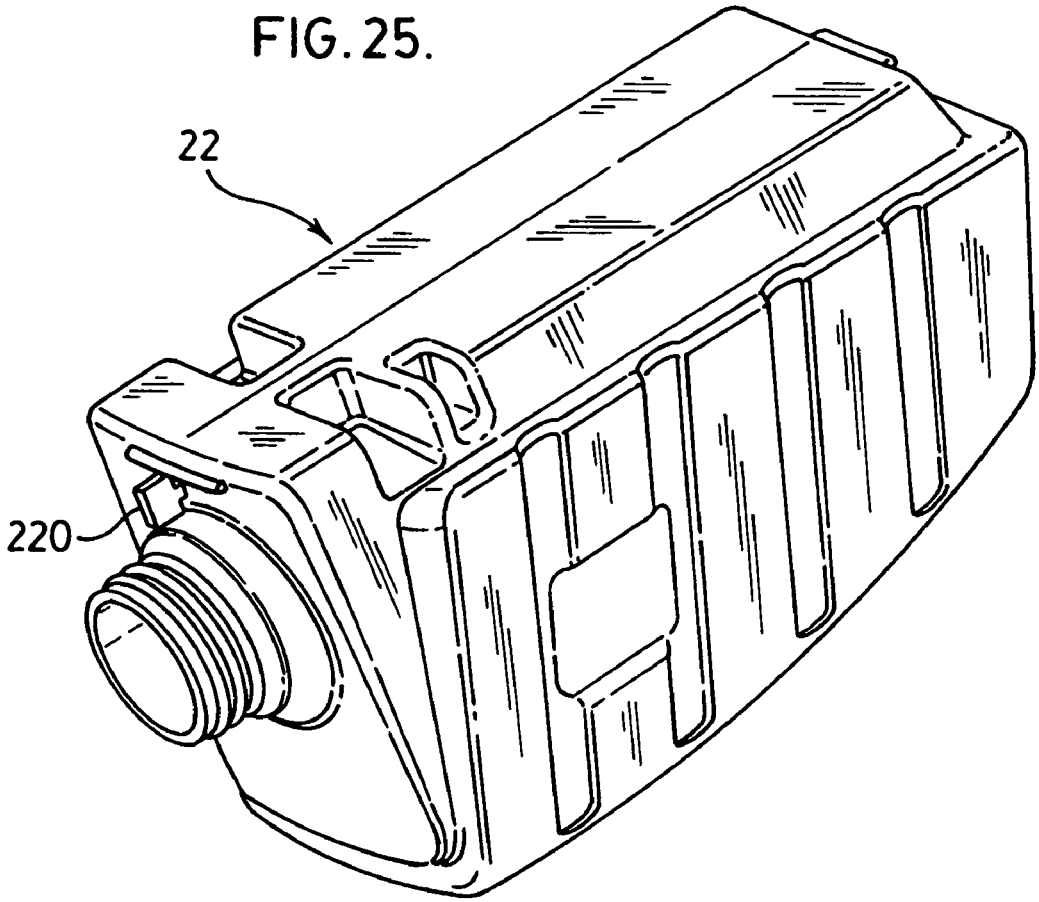
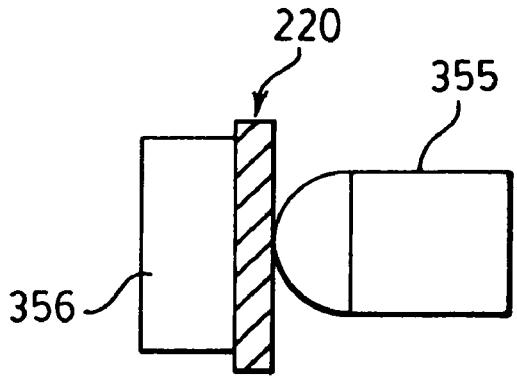
FIG. 26.

OPTICALLY KEYED DISPENSER

RELATED APPLICATION

This application is a continuation-in-part of co-pending U.S. patent application Ser. No. 11/881,753 filed Jul. 30, 2007 and claims the benefit of 35 U.S.C. 120.

SCOPE OF THE INVENTION

This invention relates to a key system for determining conditions of compatibility of a replaceable component of a mechanism, preferably an optical key system sensing electromagnetic waves exiting from a waveguide and, more particularly, to dispensing mechanisms whose operation is controlled by a key system.

BACKGROUND OF THE INVENTION

Key systems are known in which a particular key is required to be received in a key system as to control an aspect of operation. Many different types of keys are used as, for example, keys to open locks and doors.

In the context of dispensing systems, U.S. Patent Publication US 2006/0124662 to Reynolds et al, the disclosure of which is incorporated herein by reference, teaches an electronically powered key device on a refill container to be removably compatible with a dispenser. The refill container provides a coil terminated by one of a number of capacitors and the container is received in a housing that provides a pair of coils that are in spacial relationship with the installed refill coil. By energizing the housing's coil, the other coil detects the unique electronic signature which, if acceptable, permits the dispensing system to dispense material. The system thus utilizes a near field frequency response to determine whether the refill container is compatible with the dispensing system. A mechanical latching arrangement is provided to retain the container to the housing to ensure correct positioning of the coils.

Such previously known key devices using near field frequency response suffer the disadvantage that they are relatively complex and require a number of metal coils. This is a disadvantage of precluding substantially the entirety of the key device to be manufactured from plastic material and causes difficulties in recycling.

SUMMARY OF THE INVENTION

To at least partially overcome these disadvantages of the previously known devices, the present arrangement provides in one aspect an optical key system in which two components physically juxtaposed in a latching relation provide a waveguide through which electromagnetic radiation is passed with the electromagnetic radiation transmitted passing through the waveguide being measured for comparison with pre-selected parameters. In another aspect, the invention provides for controlled operation of a mechanism with a replaceable component by monitoring two keying attributes.

An object of the present invention is to provide an optical key system in which compatibility of two mating components is tested by measuring the electromagnetic radiation passed through a waveguide at least partially formed by each of the elements.

Another object is to provide an inexpensive system for determining whether a refill container is compatible with a dispensing system.

Another object is to provide an improved method of controlling the operation of a mechanism having a removable component.

In one aspect, the present invention provides a method of controlling operation of a mechanism, preferably a dispenser, having a removable component comprising the steps of measuring electromagnetic radiation passing through a waveguide carrying at least in part on the removable component and permitting operation of the mechanism only when the measured electromagnetic radiation corresponds with one or more pre-selected parameters. Preferably, the method involves directing emitted electromagnetic radiation with pre-selected input parameters selected from a plurality of input parameters. The waveguide preferably is provided with pre-selected radiation transmission properties selected from a plurality of electromagnetic radiation transmission properties. The input parameters and radiation transmission properties may be selected from wavelength, intensity, duration and placement in time. Preferably, the method is used to control the operation of a dispensing mechanism having as a removable component a replaceable reservoir containing material to be dispensed by operation of the dispenser. Preferably, the waveguide is at least partially carried by the reservoir and is coupled against removal to the reservoir or coupled to the reservoir in a manner that separation of the waveguide and the reservoir results in destruction of the waveguide and/or the reservoir. Preferably, at least part of the waveguide is carried on the removable component such that coupling or uncoupling of the removable component changes the transmission characteristics of the waveguide as, for example, by the waveguide comprising a frangible member broken on removal of the removable component. Preferably, the removable component has a plurality of waveguides and the method includes measuring the electromagnetic radiation passing through 2 or more of the waveguides, preferably preventing operation of the dispenser when the measured electromagnetic radiation of a first of two of the waveguides does not comply with its pre-selected output parameters and the measured electromagnetic radiation of a second of two of the waveguides does not comply with its pre-selected output parameters. In such a configuration there is preferably provided for the counting of each activation of a pump mechanism dispensing an allotment of the material to be dispensed. Preferably the method includes the steps of counting of each activation of a pump mechanism dispensing an allotment of the material to be dispensed, resetting counting to zero after the removal of the removable component and its replacement with a removable dispenser whose measured electromagnetic radiation of a first of two of the waveguides complies with its pre-selected output parameters and the measured electromagnetic radiation of a second of two of the waveguides complies with its pre-selected output parameters, permitting operation of the dispenser with after the removal of a removable component and its replacement with a removable dispenser whose measured electromagnetic radiation of a first of two of the waveguides complies with its pre-selected output parameters and the measured electromagnetic radiation of a second of two of the waveguides does not comply with its pre-selected output parameters but only until the number of activations of the pump mechanism from the last restart exceeds a pre-selected maximum number of activations.

A filter may be provided disposed in a transmission path through the waveguide which filter may reduce passage of electromagnetic radiation through the waveguide.

The invention, in another aspect, also provides a dispensing system including a reservoir assembly including a reservoir containing material to be dispensed in an activation unit.

The reservoir assembly is removably coupled to the activation unit for replacement by a similar reservoir assembly. An electromagnetic radiation waveguide is provided having an inlet and an outlet and providing a path for transmission of electromagnetic radiation from the inlet to the outlet. An electromagnetic radiation sensor is carried on the activation unit sensing electromagnetic radiation from the waveguide by the outlet. At least part of the waveguide is carried by the reservoir and removable therewith. A control mechanism is provided to permit operation of the dispenser only when the electromagnetic radiation sensed by the sensor appropriately corresponds to a pre-selected electromagnetic radiation profile.

In one aspect, the present invention provides a method of controlling the operation of a mechanism, preferably a dispenser, having a removable component removably coupled thereto comprising the steps of:

measuring electromagnetic radiation passing through a waveguide carried on a removable, replaceable component, and permitting operation of the dispensing mechanism only when the measured electromagnetic radiation complies with one or more pre-selected output parameters.

In another aspect, the present invention provides a dispensing system comprising:

a reservoir assembly including a reservoir containing material to be dispensed and an activation unit, the reservoir assembly removably coupled to the activation unit for replacement by a similar reservoir assembly, an electromagnetic radiation waveguide having an inlet and an outlet and providing a path for transmission of electromagnetic radiation from the inlet to the outlet, an electromagnetic radiation sensor carried by the activation unit sensing electromagnetic radiation from the waveguide via the outlet, at least part of the waveguide carried by the reservoir assembly and removable therewith, a control mechanism to permit operation of the dispenser only when the electromagnetic radiation sensed by the sensor appropriately correlates to a pre-selected electromagnetic radiation profile, preferably with a filter disposed in the path for reducing passage of electromagnetic radiation through the waveguide.

In yet another aspect, the present invention provides a method of controlling the operation of a dispensing mechanism having a removable component removably coupled thereto, the removable component including a reservoir containing a volume of material to be dispensed, the method comprising the steps of determining if a removable, replaceable component has a first keying attribute which complies with a first pre-selected attribute and has a second keying attribute which complies with a second pre-selected attribute, preventing operation of the dispensing mechanism with a removable, replaceable component which does not have the first keying attribute which complies with the first pre-selected attribute and does not have the second keying attribute which complies with the second pre-selected attribute, estimating the volume of material dispensed by counting the activation of a pump mechanism dispensing the material to be dispensed, resetting said counting to zero after the removal of the removable component and its replacement with a removable dispenser which has the first keying attribute which complies with the first pre-selected attribute and has the second keying attribute which complies with the second pre-selected attribute, permitting operation of the dispenser after the removal of a removable component and its replacement with a removable dispenser which has the first keying attribute which complies with the first pre-selected attribute and does not have the second keying attribute which complies with the second pre-selected attribute but only until the estimate of the volume of material dispensed by counting approximates a volume representative of a volume of the reservoir.

BRIEF DESCRIPTION OF THE DRAWINGS

Further aspects and advantages of the present invention will be come apparent from the following description taken together with the accompanying drawings in which:

FIG. 15 is a schematic pictorial view of a selective optical coupling device in accordance with the present invention;

FIG. 16 is a radial cross-section through one side of the wall of the collar shown in FIG. 7 along section line A-A';

FIG. 17 is a cross-section similar to that shown in FIG. 16, however, along section line B-B' in FIG. 7;

FIG. 18 is a schematic cross-section similar to that shown in FIG. 16 or 17, however, of a reduced cross-sectional area frangible portion of the wall of the collar;

FIG. 19 is a schematic pictorial representation of a section of a wave guide comprised of three modular waveguide members;

FIG. 20 is a schematic exploded pictorial view of the waveguide members of FIG. 19;

FIG. 25 is a schematic pictorial view of a reservoir bottle similar to that shown in FIG. 5; and FIG. 26 is a schematic cross-section through a frangible member carried on the reservoir bottle of FIG. 25 showing positioning of a sensor and an emitter.

DETAILED DESCRIPTION OF THE DRAWINGS

Figure 1:
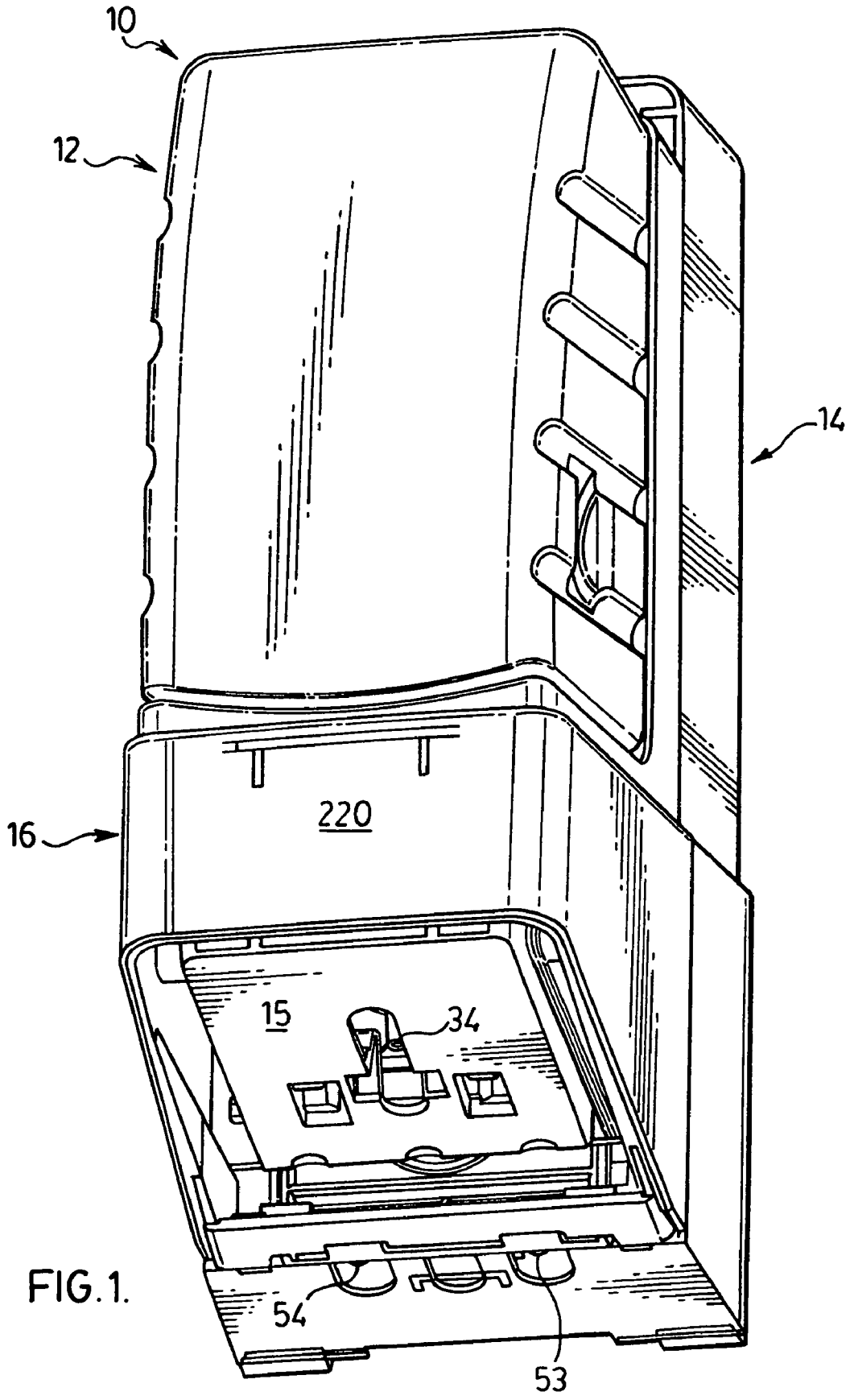
FIG. 1 is a pictorial view of a dispenser assembly in accordance with a first preferred embodiment of the present invention.
Figure 2:
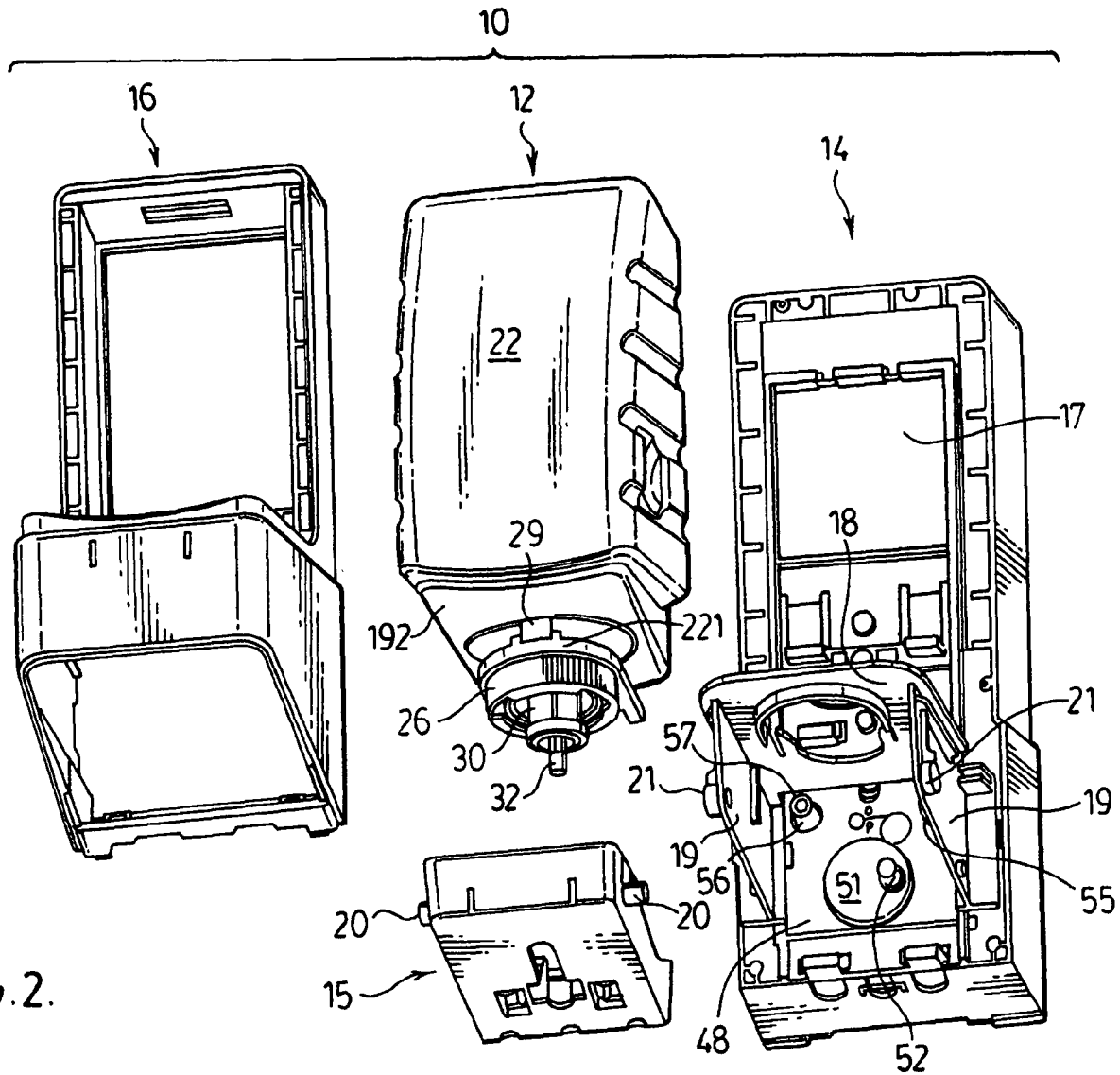
FIG. 2 is a pictorial exploded view of the dispenser assembly shown in FIG. 1.
Figure 3:
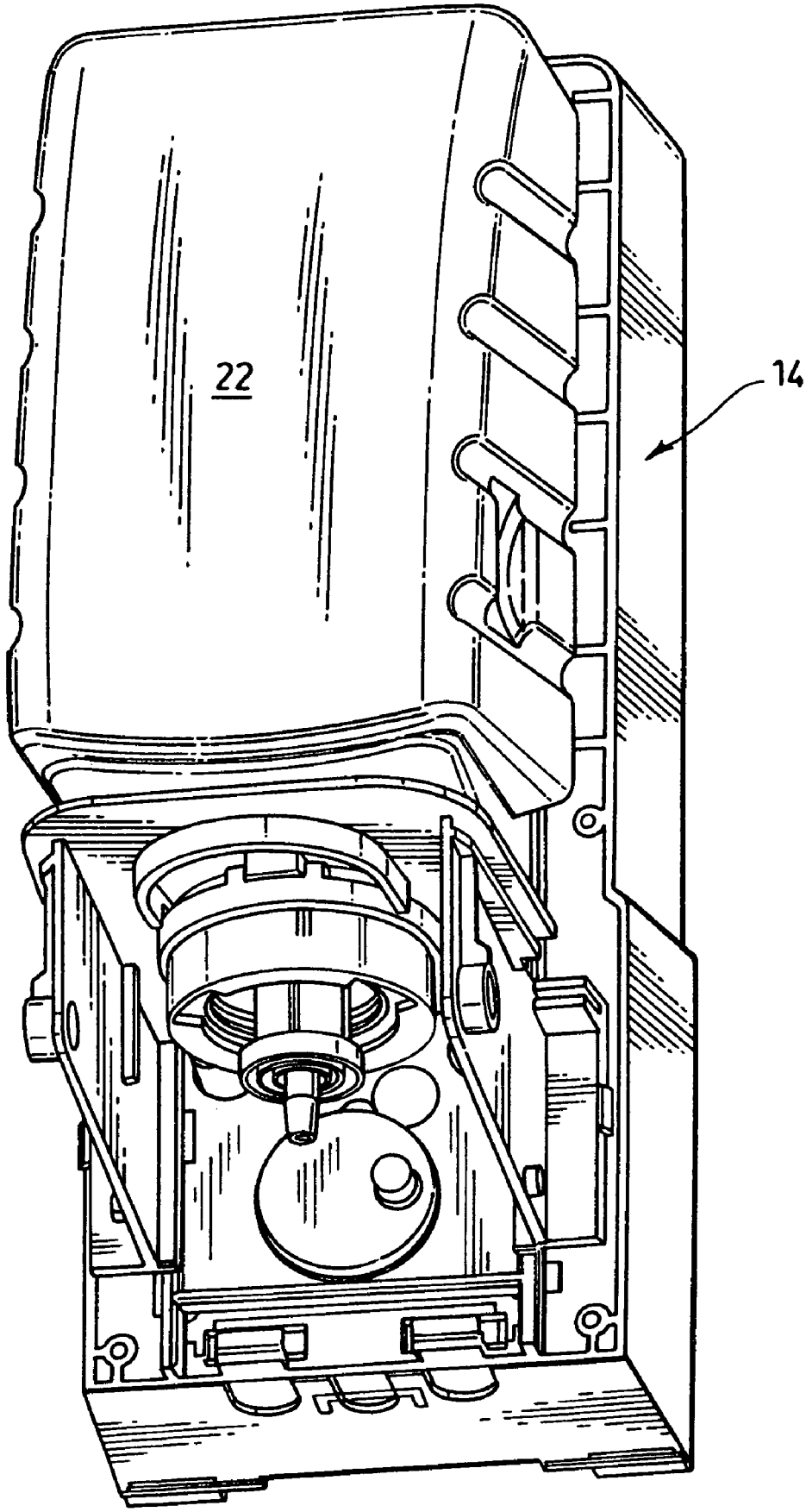
FIG. 3 is a pictorial view showing assembly of the reservoir assembly and backplate assembly shown in FIG. 2.

Reference is made to FIG. 1 which illustrates a dispenser assembly 10 in accordance with a first preferred embodiment of the present invention. The dispenser assembly 10, as best seen in FIG. 2, includes a removable reservoir assembly 12 adapted to be secured to a housing formed by a combination of a backplate assembly 14, a presser member 15 and a shroud 16. The backplate assembly 14 has a generally forwardly directed faceplate 17 from which a horizontally disposed support plate 18 extends forwardly supported by two side plates 19. The presser member 15 is pivotally mounted to the backplate assembly 14 between the two side plates 19 with stub axles 20 received in journaling bores 21 in each of the side plates 19. The housing is completed by the shroud 16 being coupled to the backplate assembly 14 to substantially enclose the support plate 18 and the presser member 15. The reservoir assembly 12 is adapted to removably couple to the assembled housing.

Figure 5:
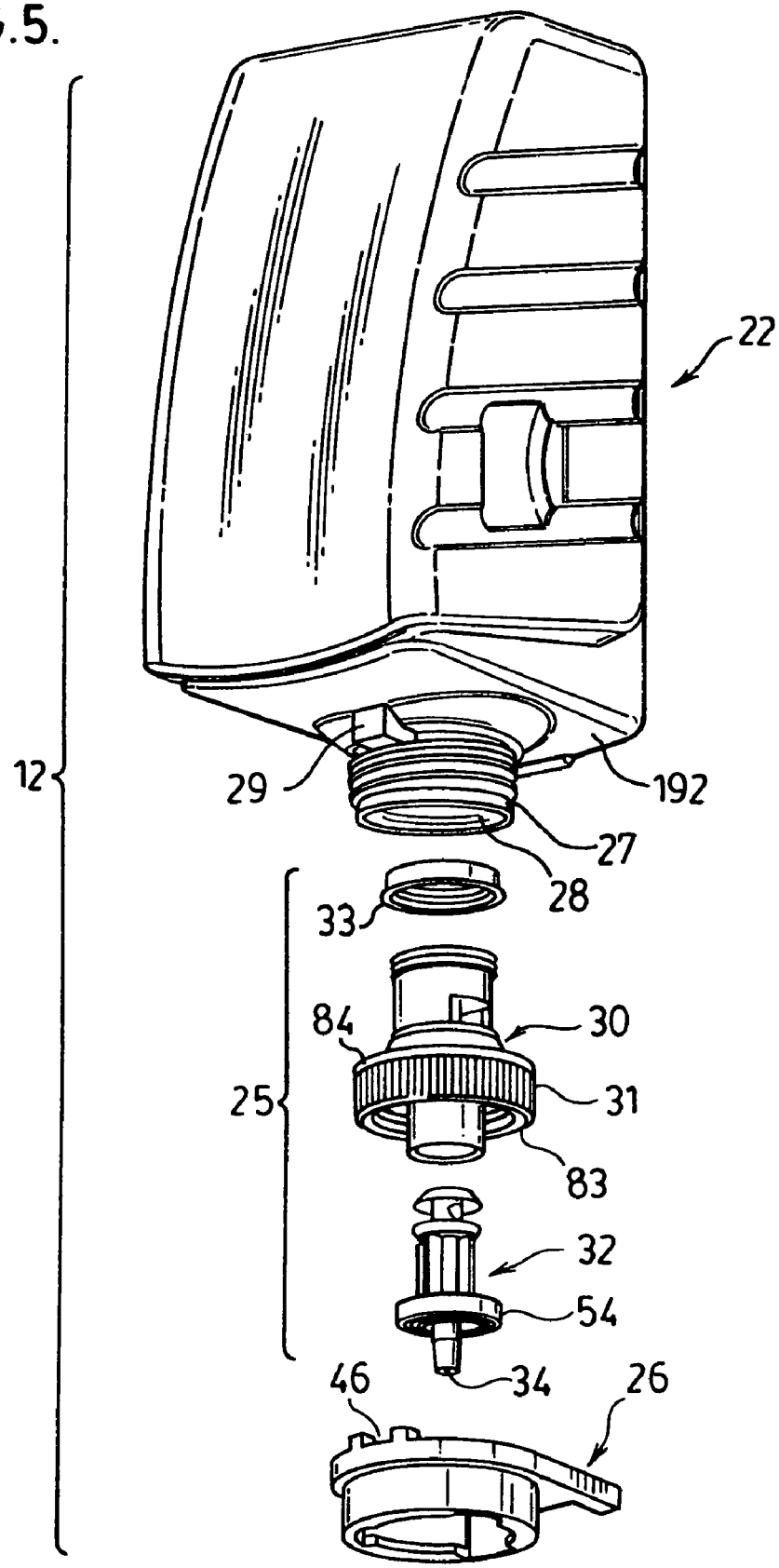
FIG. 5 is an exploded pictorial view of the reservoir assembly shown in FIGS. 2 and 3.

As best seen in FIG. 5, the reservoir assembly 12 comprises a reservoir bottle 22, a pump assembly 25 and a key collar 26. The bottle 22 has a threaded neck 27 about an outlet 28. A locking tab 29 extends forwardly and axially relative to the threaded neck 27 and is of generally rectangular shape in horizontal, axial cross-section having flat parallel side faces and an end face normal thereto. The pump assembly 25 includes a piston chamber-forming member 30 having an outer flange 31 which is internally threaded such that the outer flange 31 may be threadably engaged onto the threaded neck 27. The pump assembly 25 further includes a piston 32 and a valve member 33. The piston 32 is reciprocally movable coaxially within a cylindrical chamber formed within the piston chamber-forming member 30 so as to dispense fluid from inside the bottle 22 out of the outlet 28 internally through the piston 32 and out a discharge opening 34 of the outer end of the piston 32.

Figure 6:
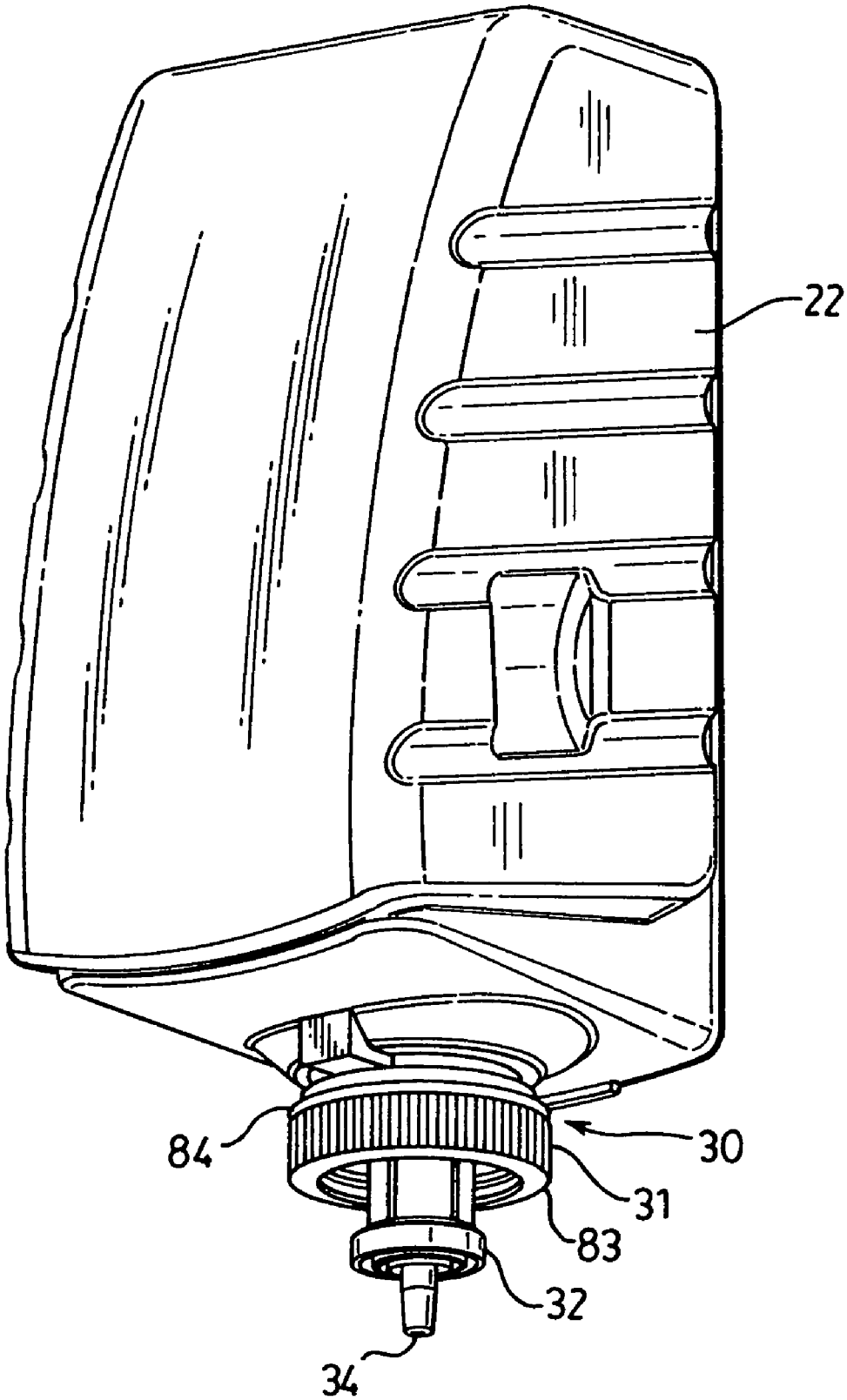
FIG. 6 is a pictorial view showing the assembled bottle, valve member, piston chamber forming member and piston shown in FIG. 5.
Figure 7:
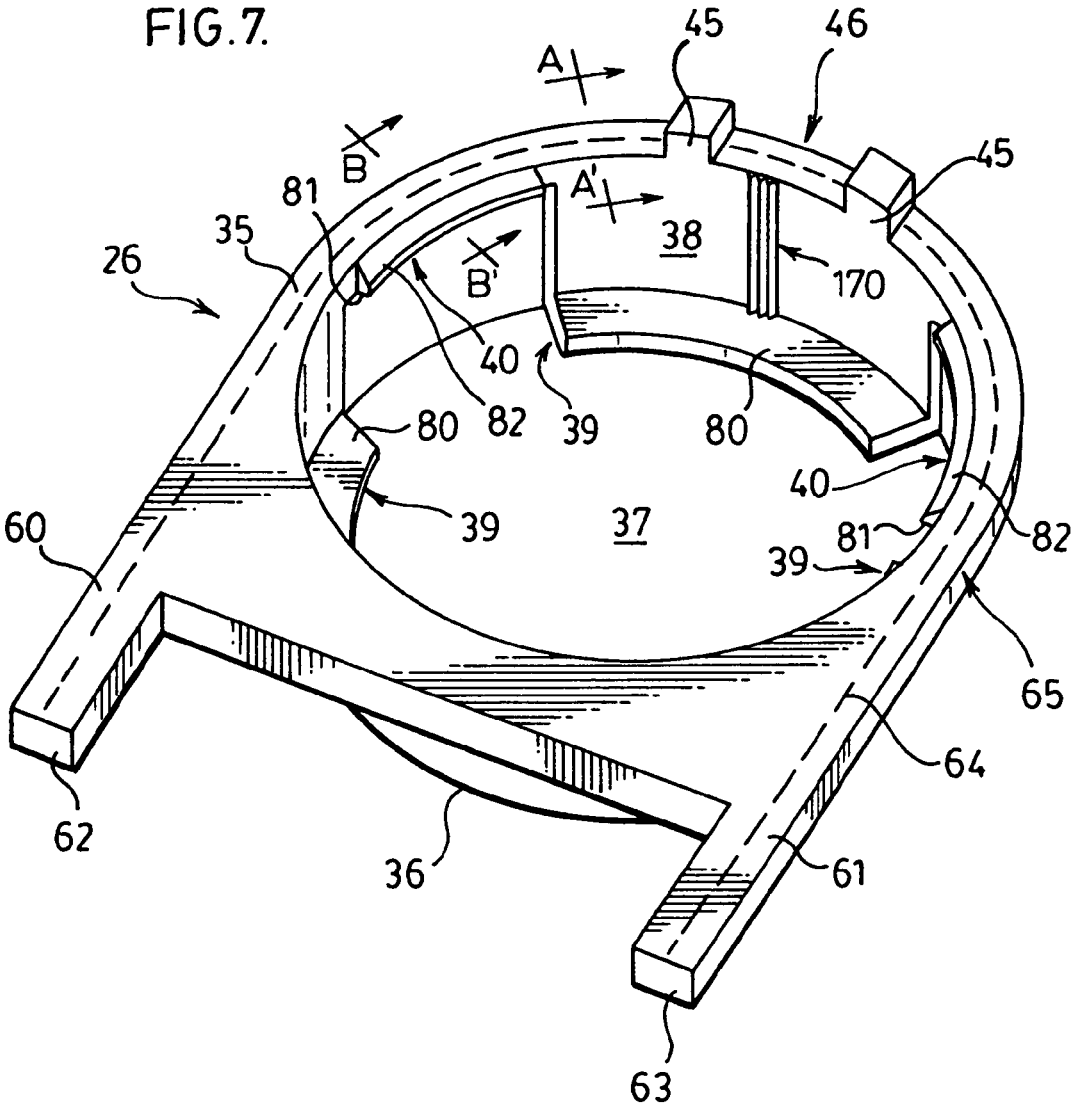
FIG. 7 is a pictorial top rear view of the collar shown in FIG. 5.

The bottle 22 and pump assembly 25 is shown assembled in FIG. 6. To the assembly as shown in FIG. 6, the key collar 26 is applied by sliding the collar 26 axially upwardly such that the collar 26 comes to be engaged in a snap-fit upon the outer flange 31 against removal from the outer flange 31 and with the locking tab 29 engaging in a slotway 46 on the collar 26 so as to prevent rotation of the collar 26 relative to the bottle 22. As seen in FIG. 7, the collar 26 has an axial upper end 35 and an axial lower end 36 with a central, generally cylindrical opening 37 extending therethrough. A generally cylindrical side wall 38 about the opening 37 carries approximate the lower end 36 three radially inwardly extending lower shoulder members 39 presenting stop shoulders 80 directed axially toward the upper end 35. Approximate the upper end 35, the side wall 38 includes three radially inwardly directed upper shoulder members 40. The upper shoulder members 40 have a catch surface 81 directed towards the lower end 36 and a bevelled camming surface 82 directed towards the upper end 35. On sliding of the collar 26 coaxially upwardly onto the outer flange 31, the camming surface 82 of the upper shoulder members 40 engage with an outer lower surface 83 of the outer flange 31 biasing the upper shoulder members 40 radially outwardly to permit the outer flange 31 to move relative the collar 26 axially toward the lower end 36 into the opening 37 of the collar 26. Once an upper end 84 of the outer flange 31 becomes located below the upper shoulder member 40, the upper shoulder member 40 returns to its inherent unbiased position with the catch surface 81 disposed above the upper end 84 of the outer flange 31 radially inwardly therefrom thus locking the outer flange 31 between the stop shoulders 80 of the lower shoulder member 39 and the catch surface 81 of the upper shoulder member 40.

The collar 26 carries on its upper end 35 a pair of upwardly extending lock tabs 45 providing a slotway 46 therebetween. The slotway 46 is sized to closely receive the locking tab 29 of the bottle 22 therebetween. When coupling the collar 26 onto the assembled bottle 22 and pump assembly 25, the slotway 46 is circumferentially aligned with the locking tab 29 on the bottle 22 such that the reservoir assembly 12 when fully assembled as shown in FIG. 2 has the locking tab 29 on the bottle 22 received within the slotway 46 preventing relative rotation of the collar 26 and bottle 12. In the reservoir assembly 12 as shown in FIG. 2, the piston chamber-forming member 30 and the collar 26 are secured to the bottle 22 against removal. That is, the key collar 26 and piston chamber-forming member 30 are preferably secured on the bottle 22 substantially against removal other than by significant breaking or deformation of the bottle 22 or key collar 26.

The extent to which removal or attempted removal of the collar 26 and/or pump assembly 25 is possible or is not possible, or may require destruction of one or more of the bottle 22, key collar 26 or piston chamber-forming member 30 can be selected as desired. For example, at the time of assembly, the bottle 22, piston chamber forming member 30 and collar 26 can be permanently secured together as with glue or by sonic welding.

In a preferred embodiment, the interior side wall 38 of the collar 26 may be knurled with axially extending alternating ribs and slotways only partially shown at 170 in FIG. 7 such that a complementarily knurled outer surface of the outer flange 31 having axially extending alternating ribs and slotways may couple with ribs on the side wall 38 preventing relative rotation of the piston chamber-forming member 30 relative to the collar 26 once the collar is applied.

With the backplate assembly 14, presser member 15 and shroud 16 assembled and, for example, secured to a wall, the assembled reservoir assembly 12 may be coupled thereto by the reservoir assembly 12 moving vertically downwardly relative the backplate assembly 14 with the collar member 26 and pump assembly 25 to pass vertically downwardly through an opening 190 in the plate 18, and the entire reservoir assembly 12 then being urged rearwardly to engage a rear support portion 191 of the plate 18 above the collar 26 and below a lower shoulder 192 on the bottle placing the piston 32 into a position for coupling with or in which it is coupled with the presser member 15. Removal of the reservoir assembly 12 is accomplished by reversed movement forwardly then upwardly.

Figure 4:
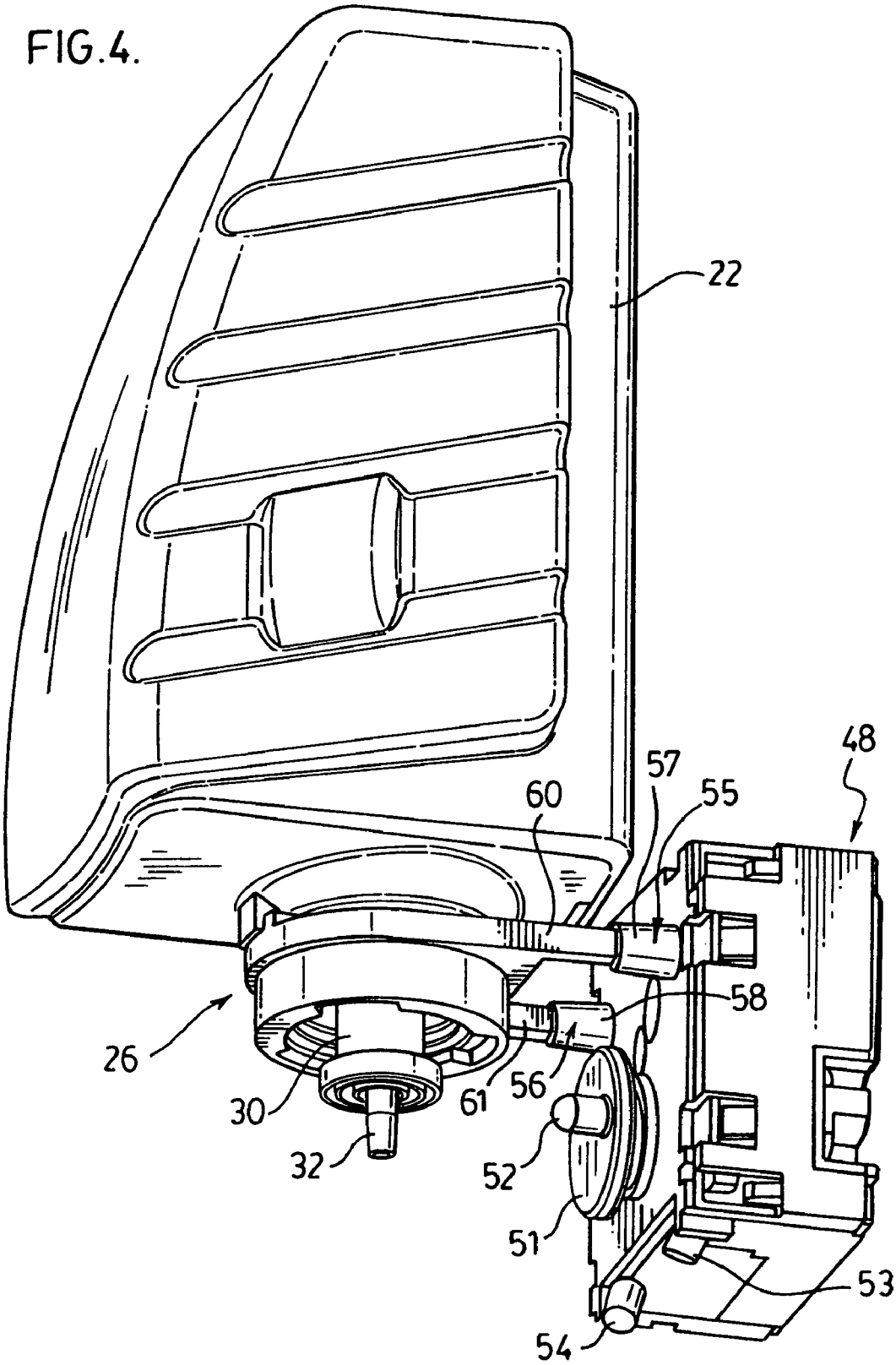
FIG. 4 is a schematic pictorial side view showing the relative positioning of the reservoir assembly and an activation unit in the assembled dispenser of FIGS. 1 and 3.
Figure 8:
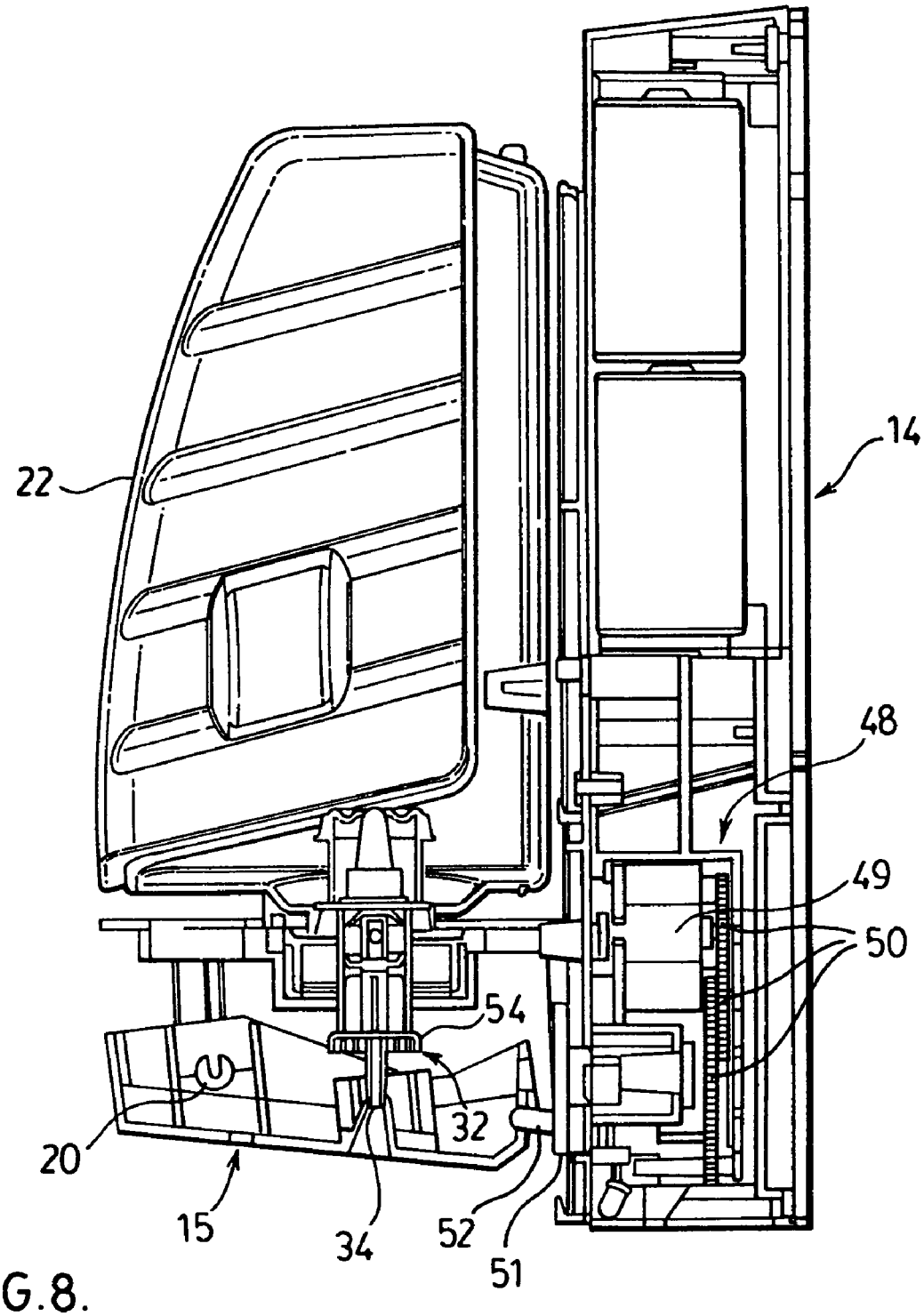
FIG. 8 is a schematic cross-sectional side view of the dispenser assembly 10 shown in FIG. 1.

The backplate assembly 14 includes and carries an activation unit 48 best seen in FIG. 4. The activation unit 48 includes as only schematically shown in FIG. 8, an electric motor 49 which rotates via a series of gears 50, a drive wheel 51 carrying an eccentrically mounted axially extending cam post 52 shown in FIG. 4. The cam post 52 couples to an inner end of the presser member 15 such that in rotation of the drive wheel 51 in one full revolution, the presser member 15 is pivoted about its stub axles 20 downwardly and then upwardly, returning to the same position. The presser member 15 is coupled to the piston 32 by engagement between catch members (not shown) carried by the presser member 15 with an engagement flange 54 on the piston 32. Such catch members and engagement may be similar to that described in U.S. Pat. No. 5,373,970 to Ophardt dated Dec. 20, 1994, the disclosure of which is incorporated herein by reference, which engagement necessarily results on coupling of the reservoir assembly 12 with the backplate assembly 14.

In one cycle of operation, the motor 49 is operated so as to rotate the drive wheel 51 360 degrees and thus move the piston 32 in a single stroke inwardly and outwardly to dispense an allotment of fluid from the bottle 22. The motor 49 is an electric motor and its operation may be controlled by a control mechanism receiving various inputs. The activation unit 48 shown is adapted to be used as a touchless dispenser in which the presence of a user's hand below the presser member 15 underneath the discharge outlet 34 is sensed by a hand sensing system including an electromagnetic radiation emitter 53 located at the bottom front of the activator unit 48 to direct radiation downwardly and forwardly towards the position the user's hand is to be placed and an electromagnetic radiation sensor 54 also located near the bottom front of the activation unit 48 adapted to sense radiation reflected off the user's hand. The hand sensing system, on suitable receipt of reflected radiation from the hand, provides a suitable signal to the control mechanism indicating the presence of the hand, for example, satisfying at least one condition for operation of the motor.

While the use of a hand sensing mechanism involving electromagnetic emitter 53 and sensor 54 is illustrated, many other systems may be provided to provide a primary indication that fluid should be dispensed. For example, these could include providing a simple on/off switch to be manually activated, or a requirement for identification as by use of a fingerprint as disclosed, for example, in U.S. Pat. No. 6,206,238 to Ophardt, issued Mar. 27, 2001.

The activation unit 48 also includes portions of an optical key system towards determining if the reservoir assembly 12 is compatible with the activation unit 48, that is, whether the reservoir assembly 12 meets pre-selected criteria to permit use with the activation unit 48. The activation unit 48 includes an electromagnetic radiation key emitter 55 and an electromagnetic radiation key sensor 56. Each is provided on the front face of the activation unit 48 on an upper portion of the activation unit and directed forwardly. As best seen in FIG. 2, the key emitter 55 includes a generally cylindrical shroud 57 about its lamp and the key sensor 56 includes a similar shroud 58 about its sensor, which shrouds 57 and 58 substantially prevent any transmission of electromagnetic radiation therethrough and effectively serve to directionalize the key emitter 55 and key sensor 56 so as to restrict emissions or receptions of either to light passing through the outer end of the shrouds 57 and 58. As best seen in FIGS. 4 and 7, the collar 26 has two arms 60 and 61 which extend rearwardly from the collar 26 toward each of the key emitter 55 and key sensor 57. The collar 26 provides an electromagnetic radiation wave guide from an end face 62 at the end of arm 60 through the collar 26 to the face 63 at the end of the arm 61 providing an outlet to the waveguide. The waveguide is schematically illustrated in dashed lines as 64 in FIG. 7 as extending in a generally U-shape within a U-shaped rim 65 of material disposed proximate the upper end 35 of the collar 26 about its outer periphery.

Referring to FIG. 4, electromagnetic radiation emitted by the key emitter 55 enters the waveguide 64 via the inlet end face 62 and is conducted via the waveguide 64 through the collar 26 with electromagnetic radiation to exit the waveguide 64 via the outlet end face 63 with the radiation exiting the waveguide via the outlet end face 63 to be sensed by the key sensor 56. The activation unit 48 includes a key control system under which as a prerequisite to dispensing, having regard to the electromagnetic radiation emitted by the key emitter 55, the electromagnetic radiation sensed by the key sensor 56 is to comply with one or more pre-selected parameters. As by way of a non-limiting example, the key emitter 55 may emit electromagnetic radiation within a selected range of wave lengths and, in the absence of the key sensor 56 sensing electromagnetic radiation within the range of emitted radiation, the motor 49 may not be permitted to operate. Thus, in the simplest case, should a non-compliant reservoir assembly 12 which has the bottle 22, pump assembly 25 but not the collar 26, be coupled to the backplate assembly 14 and would not have a waveguide, the radiation of a selected wavelength emitted by key emitter 55 would not be directed to or sensed by the key sensor 56 and the control mechanism of the activation unit would not permit dispensing.

In the preferred embodiment, the collar 26 may preferably be formed as by injection moulding from a plastic material which permits transmission of electromagnetic radiation therethrough. As is known to a person skilled in the art, various plastic materials such as polycarbonate plastics can be used which provide a resultant product having electromagnetic radiation transmitting properties. Radiation which may enter the light transmitting collar 26 as by being directed normal to the inlet end face 62 will, to some extent, be reflected internally by reason of such light impinging at relatively low angles on the external surfaces of the collar forming effectively the sides of the wave guide. A portion of the radiation directed into the collar 26 is passed through the collar 26 as around the U-shaped external rim 65 with some proportion of the radiation to be directed substantially perpendicular to the exit end face 63 to exit the waveguide and be sensed by the key sensor 56.

The collar 26 may be formed as unitary element all from the same radiation transmitting properties or may be formed from a number of different materials. For example, to increase internal reflection, exterior surfaces of the collar 26 especially about the rim 65 could be coated with a reflective material other than on the inlet end face 62 and the outlet end face 63. The collar 26 may be formed such that merely a U-shaped portion of the collar, for example, substantially corresponding to the U-shaped rim 65 may comprise light transmitting materials and the remainder of the collar may be formed of other plastic materials.

The collar 26 may be formed to incorporate therein one or more pre-existing optical fibres, for example, disposed to extend internally within the U-shaped rim as with an inlet end of an optical fibre to be presented at the inlet end face 62 and an outlet end of the optical fibre to be presented at an outlet end face 63.

Figure 9:
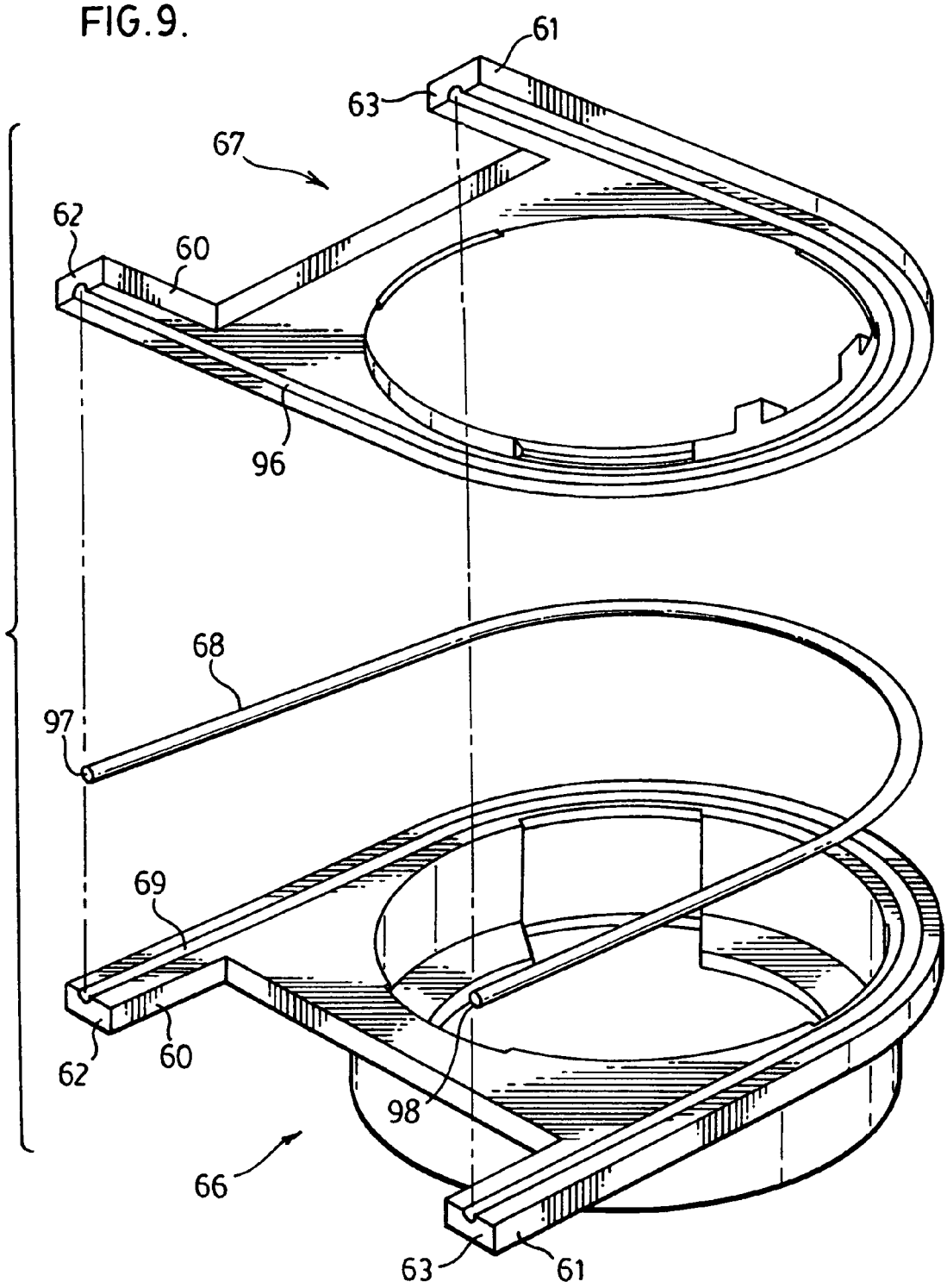
FIG. 9 is an exploded pictorial view of a second embodiment of a collar which, when assembled, would have external features identical to that shown in FIG. 7.

Reference is made to FIG. 9 which shows a second embodiment of a collar 26 in accordance with the present invention which will have, when assembled, an identical appearance to the collar 26 shown in FIG. 7. The collar 26 as shown in FIG. 9 is formed from three pieces, namely, a base 66, a top 67 and an optical fibre member 68. The base 66 and top 67 are injection moulded from plastic and are adapted to snap-fit together against separation. The base 66 has an upwardly directed U-shaped half channel 69 formed therein and the top 67 has a similar downwardly directed U-shaped half channel 96. The optical fibre 68 is positioned sandwiched between the base 66 and top 77 received between the half channel member 69 carried on the base and the half channel member 96 carried on the top. The optical fibre 68 has a first end 97 open to the end face 62 of the arm 60 and a second end 98 open to the end face 63 of the arm 61 such that the optical fibre member 68 provides the waveguide through the collar 26. In the assembled collar 26, the optical fibre member 68 is secured within the collar 26 against removal. The optical fibre member 68 may comprise a short length of a conventional optical fibre or may preferably comprise an extrusion of plastic material having appropriate light transmitting properties such as a cylindrical extrusion of flexible polycarbonate or other plastic.

The channelway which is formed by combination of the half channels 69 and 96 may preferably have adjacent each end face 62 and 63 a port portion of restricted cross-sectional closely sized to tightly hold each end of the optical fibre member 68 therein and with interior portions of the channelway interior from the port portions of increased diameter to facilitate easy insertion of interior portions of the optical fibre members 68.

Figure 10:
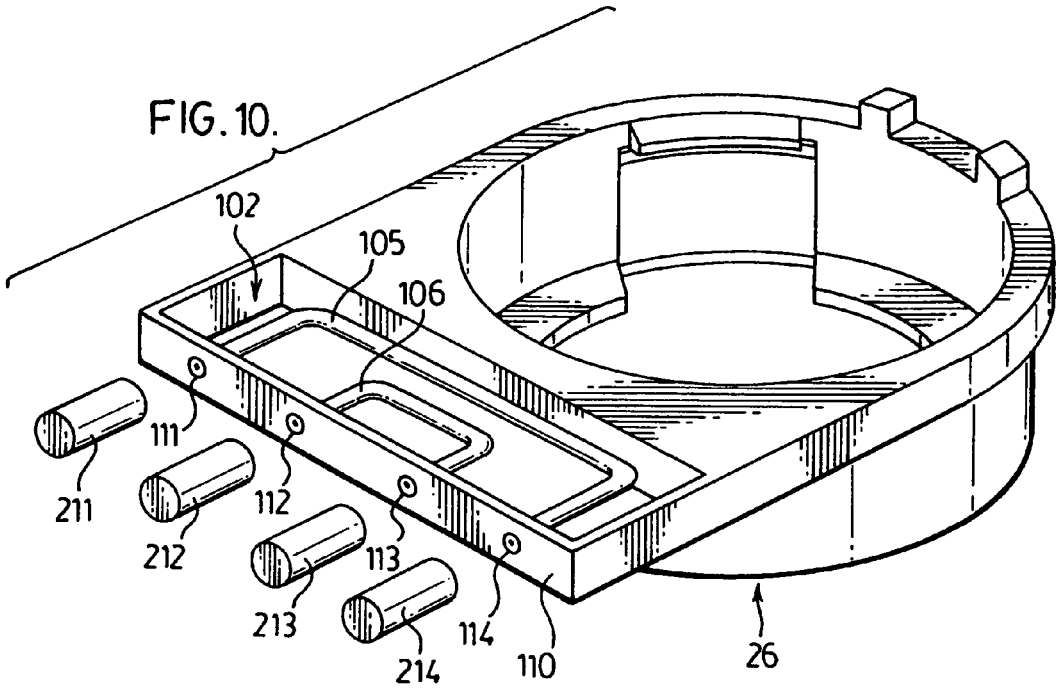
FIG. 10 is a schematic pictorial view showing a third embodiment of a collar similar to that in FIG. 7 juxtapositioned with four key emitters/sensors to be carried on the backplate assembly.

Reference is made to FIG. 10 which illustrates a third embodiment of a collar 26. As seen in FIG. 10, at the rear end of the collar 26, an internal compartment 102 is provided closed at its rear by a rear wall 110 having four port portions 111, 112, 113 and 114 therethrough. Two optical fibre members 105 and 106 are shown. Each optical fibre has a first end secured in one of the port portions and a second end secured in another of the port portions such that each optical fibre member provides a respective waveguide from one port portion to a second port portion. Opposite each of the port portions, four elements 211, 212, 213 and 214 are schematically shown, each of which is intended to schematically illustrate either a key emitter or a key sensor to be carried on an activation unit such as shown, for example, in FIG. 4 suitably located in front of a respective of the port portions. Of the four elements, preferably, at least one comprises an emitter and at least one comprises a sensor. In one preferred embodiment, each of these elements may each comprise either an emitter or a sensor or, preferably, both. Preferably, each of the elements 211, 212, 213 and 214 are carried on a computerized control circuit permitting selected operation of each of the elements either as an emitter or a sensor or to be inoperative. Such an activation unit can be electronically keyed to adopt a particular configuration of sensors and emitters.

In the embodiment illustrated in FIG. 10, two optical fibre members 105 and 106 are shown. It is to be appreciated that merely one optical fibre member need to be provided. For example, a single optical fibre member could be provided to connect any two of the port portions. For example, an optical fibre could have one end connected to the port portion 111 and a second end connected to any one of the port portions 112, 113 or 114. In a simple configuration, the element 121 could be programmed to be a key emitter and a selected one of the elements 212, 213 and 214 could be selected to be a sensor having regard to the corresponding port portion to which the end of a single optical fibre member may be connected. The collar member thus, by suitable positioning of the optical fibre member, may be configured to provide a waveguide at a matching location. If desired, a second optical fibre member could be used to couple the remaining two of the port portions which are not assumed by the first optical fibre member as seen in FIG. 10.

Each of the optical fibres which is used may have different radiation transmission characteristics. For example, one of the optical fibre members may be tinted blue such that that optical fibre serves as a filter to prevent passage therethrough of light which is not within a range of corresponding blue wavelengths. Similarly, the other optical fibre could be tinted red and yellow so as to act as filters merely permitting the passage of red or yellow wavelength light.

Figure 11:
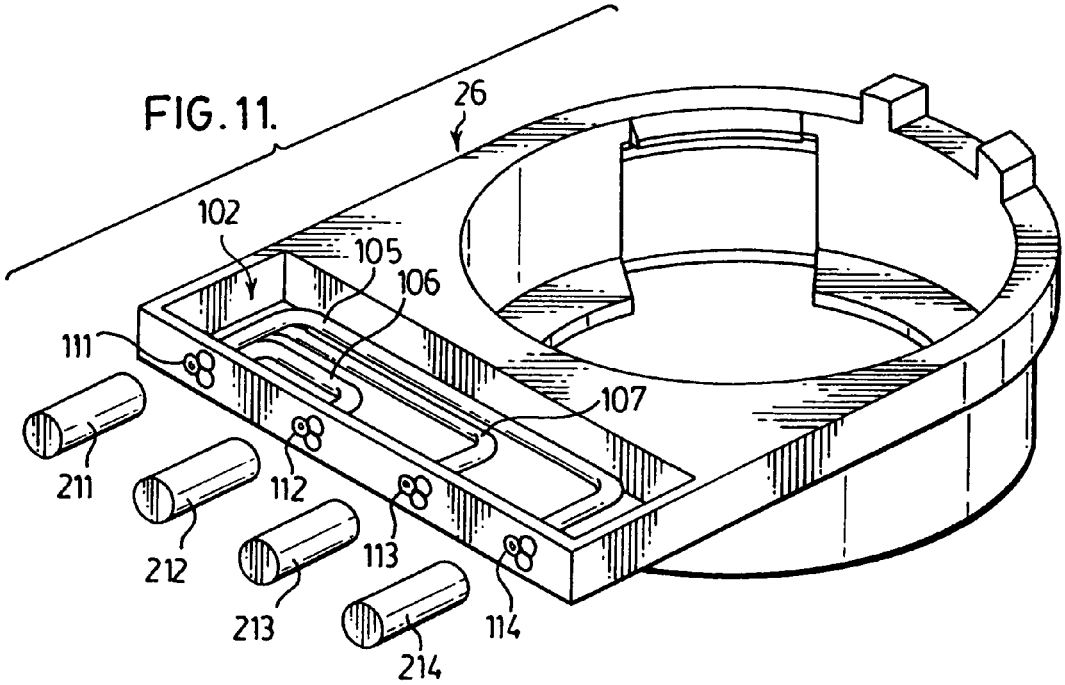
FIG. 11 is a schematic pictorial view similar to FIG. 10 but showing a fourth embodiment of a collar.

Reference is made to FIG. 11 which illustrates a fourth embodiment of a wave guide in accordance with the present invention similar to that shown in FIG. 10, however, incorporating three different optical fibres 105, 106 and 107. Additionally, each of the port portions 111, 112, 113 and 114 are each shown as having three opening therethrough, each of which opening is adapted to receive the end of one optical fibre member. Thus, up to three optical fibre members can be received in each port portion. In the particular configuration shown in FIG. 11, a first end of each of the three optical fibres is connected to the port portion 111, however, merely one end of a different one of the three optical fibres is connected to each of the ports 112, 113 and 114. In the embodiment illustrated in FIG. 11 as one preferred non-limiting example, the optical fibre 105 preferably is tinted blue so as to act as a filter and prevent the passage of light other than of corresponding blue wavelength light therethrough. The optical fibre 106 is tinted red and acts as a filter to prevent the passage of light other than corresponding red wavelength light therethrough. The optical fibre 107 is tinted yellow and acts as a filter to prevent the passage of light other than corresponding yellow wavelength light therethrough. The element 211 may be adapted to selectively emit light containing all of blue, red and yellow light or merely one or more of blue, red or yellow light at different times and each of the sensors 212, 213 and 217 will look at an appropriate time for light, the absence of light of any wavelength or, alternatively, light at a selected blue, red and/or yellow wavelength.

Figure 12:
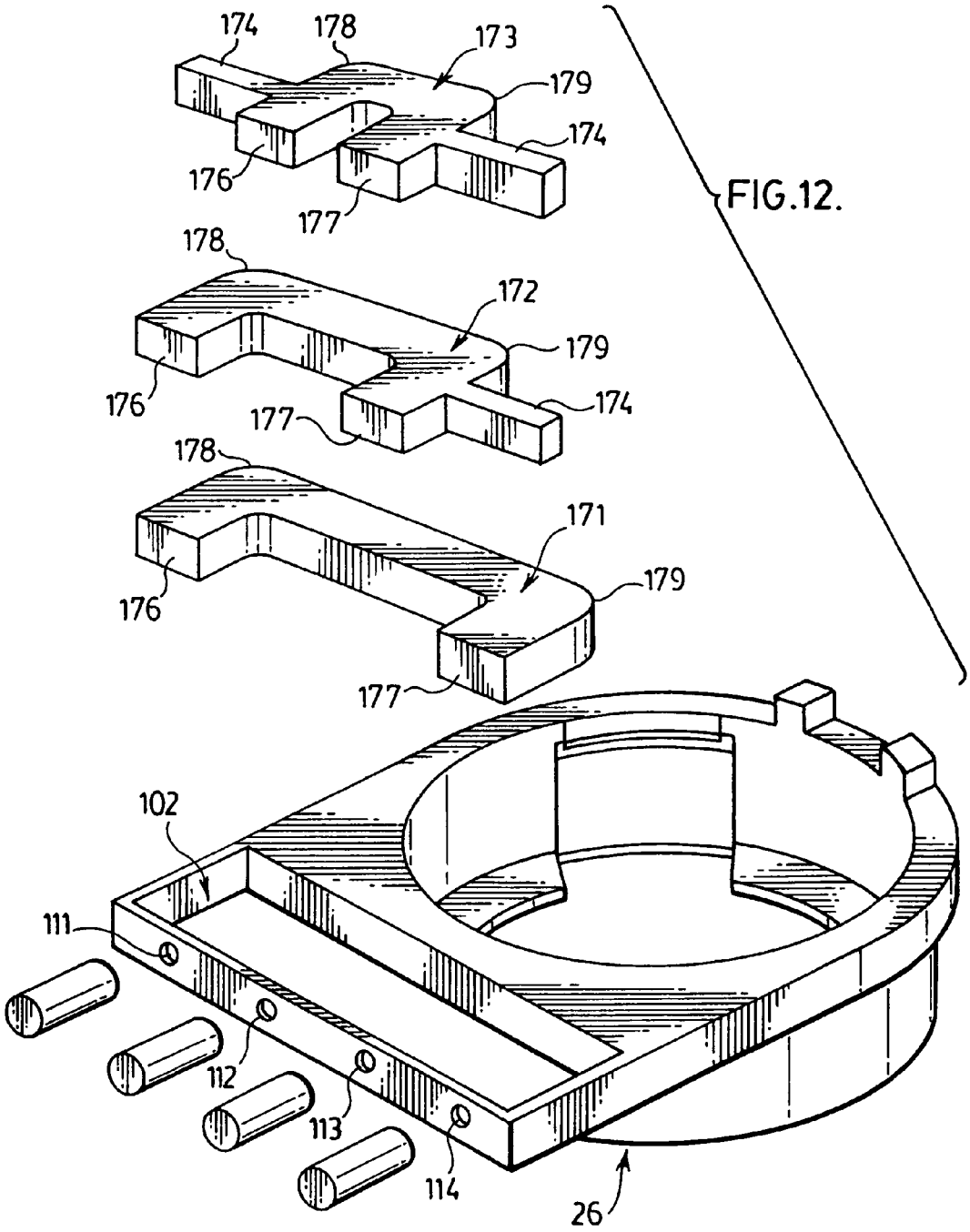
FIG. 12 is a schematic exploded pictorial view similar to FIG. 10 but showing a fifth embodiment of a collar with three alternate waveguide inserts for use therewith.

Reference is made to FIG. 12 which illustrates a fifth embodiment of a collar member 26 having similarities to that illustrated in FIG. 10, however, in which the optical fibre members have been removed and are to be replaced by one of the three waveguide inserts shown as 171, 172 and 173 in schematic exploded perspective in FIG. 15. Each of the waveguide inserts is preferably injection moulded from a light transmitting material such as polycarbonate. Insert 171 is adapted to provide light transmission from the portal portion 111 to the portal portion 114. An insert 172 is adapted to be inserted as shown to provide communication between portal 111 and portal 113 or if inverted 180 degrees to provide communication between portal 112 and portal 114. Insert 173 is adapted to provide communication between portals 112 and 113. By the suitable selection of a relatively simple injection moulded plastic insert 171, 172 or 173, the collar member 26 may be configured to have a desired waveguide therein. Each of the inserts may be provided to have different radiation transmission properties and may, for example, act as a colour filter. Each insert 171, 172 and 173 is sized to closely fit inside the compartment 102 with side locating tabs 174 provided to extend the side-to-side dimension of inserts 172 and 173. Each insert has two faces 176 and 177 to serve as an inlet/outlet to its waveguide relative its respective portals. Curved portions 178 and 179 of the wall of the insets opposite the faces 176 and 177 assist in directing radiation internally from one face to the other.

Figure 13:
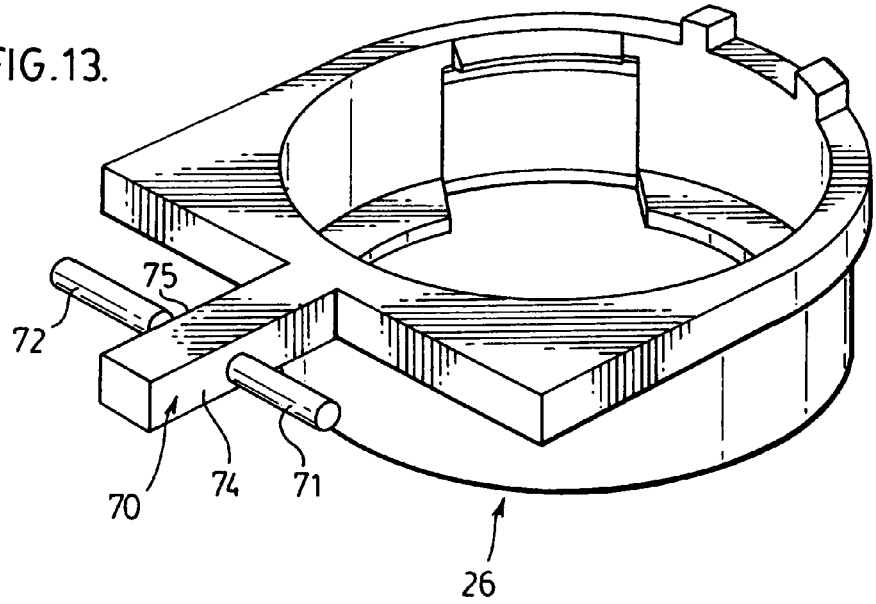
FIG. 13 is a schematic pictorial view of a sixth embodiment of a collar also schematically showing a key emitter and key sensor to be carried on a backplate assembly.

Reference is made to FIG. 13 which schematically illustrates a sixth embodiment of the collar and key sensing system in accordance with the present invention. As seen in FIG. 13, the collar 26 is identical to the collar in the first embodiment of FIG. 7 with the exception that the arms 60 and 61 are removed and a key member 70 is provided to extend rearwardly. The actuation unit 48 is modified such that a key emitter 71 is located to one side of the key member 70 directing radiation sideways through the key member 70 and a key sensor 72 is on the other side of the key member 70 directed sideways. In this manner, the key emitter 71 directs radiation into an inlet face 74 on one side of the key member 70 and the key sensor 72 senses radiation passing outwardly through an outlet face 75 on the other side of the key member 70. The key member 70 preferably provides a waveguide for transmission of electromagnetic radiation. As one non-limiting example, the waveguide may include a waveguide which acts like a filter which substantially prevents any transmission of radiation therethrough of light of a first certain characteristic or wavelength yet lets light of a second characteristic or wavelength pass through, and the key sensor 72 at the time light of both the first and second certain characteristic or wavelengths is emitted by the key emitter 71 looks for the absence of light of the first characteristic or wavelength and the presence of light of the second characteristic or wavelength.

With the key member 70 located in a vertical slotway between the key emitter 71 and the key sensor 72, their engagement can prevent relative rotation of the reservoir assembly 12 relative the backplate assembly 14.

While the embodiment illustrated in FIG. 13 shows a collar merely with the key members, it is to be appreciated that a modified collar could be provided in having both the arms 64 and 65 providing a first waveguide and the key block providing a second guide and that two separate key emitters may be provided and two separate key sensors may be provided.

Figure 14:
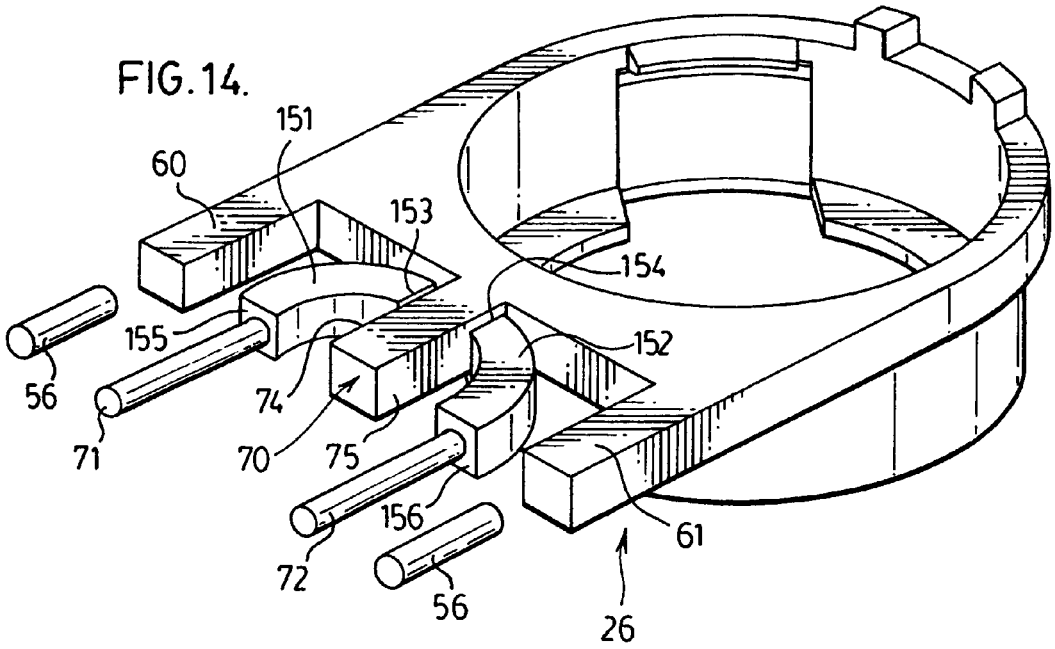
FIG. 14 is a schematic pictorial view of a seventh embodiment of a collar also schematically illustrating four key emitters/key sensors to be carried on the backplate assembly.

Reference is made to FIG. 14 which illustrates a seventh embodiment of a key member in accordance with the present invention which has features similar to those shown in FIG. 7 and in FIG. 13. In FIG. 14, a central key member 70 is provided serving as a waveguide for passage of radiation laterally therethrough. On either side of the key member 70, there are provided a pair of waveguide extensions 151 and 152 adapted to be securely carried on the backplate assembly. Each waveguide extension includes an outer face 153 or 154 directed laterally towards a respective face 74 or 75 of the key member 70 and an inner end 155 or 156 directed rearwardly and adapted for optical coupling with a key emitter/sensor element 71 or 72 also carried on the backplate assembly. As in the embodiment of FIG. 7, the collar 26 includes at the end of each arm 60 and 61, end faces 62 and 63 served to be optically coupled with two key emitters/sensors 56 and 57 carried on the activation unit.

In the embodiment illustrated in FIG. 13, a portion of the waveguide is provided as the waveguide extensions 151 and 152 on the activation unit and a portion of the waveguide is provided as the key member 40 on the collar member 26.

Reference is made to FIG. 15 which illustrates a selective optical coupling mechanism illustrating a pair of key emitter or sensor elements 56 and 57 disposed opposite to optical first windows 163, 164 carried in a coupling unit 165. The coupling unit 165 is a generally rectangular shaped member with a pair of cavities 166, 167 having a narrow end 168 open to the first windows 163, 164 and a wide end 169 open to second windows 181, 182, 183 with two for each of the cavities. A waveguide member 184 having a generally parallelogram shape is adapted to be received within either cavity 166 or 167 in a position which connects a first window to one of the second windows. The waveguide member 184 can be rotated 180 degrees and placed in a cavity so as to provide a waveguide between a first window at the first end and a different other of the second window at the second end. Such an arrangement can be provided either in a cavity in the collar member 26 or in a portion of a cavity on the activation unit and thus can form another method for mechanically selecting a relative path of a portion of the waveguide either carried by the collar 26 or the activation member 48.

It is to be appreciated that different waveguide members 184 may have different properties such as different abilities to transmit, filter, block or polarize electromagnetic radiation passed therethrough. For example, a plurality of such members could be provided of different tinted colours, blue, red, yellow, green and the like and provide simple members which can be readily manually inserted to a customized activation member or a collar member for a particular desired configuration.

In accordance with the present invention, the electromagnetic radiation may be selected having regard to pre-selected parameters. These parameters may include radiation within one or more ranges of wavelengths, electromagnetic radiation within one or more ranges of intensity, polarized electromagnetic radiation, and electromagnetic radiation within one or more ranges of duration and at one or more different points in time.

The waveguide which is provided may have electromagnetic radiation transmitted properties selected from a plurality of properties and including the ability to transmit one or more ranges of wavelengths and or the ability to block one or more ranges of wavelengths, the ability to restrict the intensity of electromagnetic radiation which can be transmitted through the waveguide, preferably, as a function of most of the waveguide. The transmission properties may restrict the transmission of radiation having a first range of wavelengths yet permit transmission of radiation having a range of second wavelengths.

Reference is made to FIGS. 16 and 17 which illustrate cross-sections through the collar 26 shown in FIG. 7 along section lines A and B. respectively, in axially extending planes which extend radially from a center through the central opening 37. In each of FIGS. 16 and 17, the radially extending rim 65 is shown as rectangular in cross-section containing and effectively forming throughout the inner rectangular cross-sectional area of the rim 65 the waveguide 64.

FIG. 18 illustrates a schematic cross-sectional similar to that shown in FIGS. 16 and 17, however, at a cross-sectional point in between section lines A and B at a point in between a circumferential end of the shoulder member 40 and before the stop shoulder 80 is provided. The cross-sectional area shown in FIG. 18 superimposes a dashed line showing the outline of the cross-section of FIG. 17. The cross-section in FIG. 18 is of a considerably reduced cross-sectional area compared to that shown in either FIG. 16 or 17. That circumferential portion of the collar 26 represented by the cross-section of FIG. 18 comprises, in effect, a frangible portion. Insofar as a person may attempt to remove the collar 26 from engagement on the reservoir assembly, circumferentially applied forces on being transmitted to the reduced cross-sectional segment shown in FIG. 18 will result in breaking and rupture of the collar through this reduced cross-sectional area, thus, breaking and rupturing the wave guide 64. In FIG. 18, the cross-sectional area of the waveguide 64 is shown to be a reduced sized triangular portion compared to the rectangular area shown in FIGS. 16 and 17. The cross-sectional area of the waveguide through the frangible portion is selected to be adequate to permit radiation to pass through the waveguide in normal use. When the collar member 26 may be broken by circumferential severing through the reduced cross-sectional area portion of FIG. 18, the waveguide 64 will be broken with the broken waveguide preferably preventing or impairing the ability of the waveguide to transfer radiation through the break point. In the embodiment illustrated in FIG. 18, it is expected that initial fracture may occur in the lower portion below the triangular waveguide which may assist in splitting through the waveguide from the lower apex of the triangular waveguide upwardly to a wider portion at the top.

Many modifications and variations of frangible waveguides or waveguides which will break if a collar is attempted to be physically removed can be envisioned. For example, in the context of a waveguide which incorporates a pre-existing optical fibre member such as shown in FIG. 9, a mechanism can be structured to sever the optical fibre member as a requirement of removal of the collar.

Reference is made to FIG. 19 which illustrates a schematic pictorial view of a portion of a waveguide 200 formed from three modular waveguide elements 201, 202 and 203. The waveguide element 201 has a first end face 210 and a second end face 211. The member 201 is a constant cross-sectional shape between the end faces. As schematically illustrated by the parallel lines 212, the guide wave member 201 is polarized so as to restrict light passing between the end faces 210 and 211 to being light which propagates parallel to each other in a certain direction. Waveguide member 212 is identical to waveguide member 210, however, is shown in the embodiment as rotated 90 degrees such that it has the schematic parallel lines 212 of waveguide member 202 is perpendicular to the parallel lines 212 on the waveguide member 201. When arranged in this configuration as shown in FIGS. 19 and 20, the waveguide members 201 and 202 effectively block all light transmission therethrough. Waveguide member 203 is shown as a similarly sized waveguide member which may be selected, for example, to be of a particular colour such as the colour blue. The waveguide members 201, 202 and 203 are each modular members which can be replaced or substituted by other members and thus by simple insertion or removal of different modular members provide for different light transmission characteristics of the resultant waveguide. While the waveguide member 203 is shown as being of a particular colour, it is to be appreciated that each of the waveguides 201 and 202 could be provided as modular elements in a plurality of different colours.

Each of the waveguide members 201, 202 and 203 may be stacked immediately adjacent to each other and, for example, to form a central portion of the replaceable waveguide 184 is shown in FIG. 15. It is to be appreciated that in a manner similar to that shown in FIG. 15, a coupling unit similar to 165 could be provided as with a rectangular recess so as to receive each of the three waveguide members 201, 202 and 203 aligned in a row.

One or more of the waveguide members 201, 202 and 203 may be provided as part of a waveguide on the activation unit and any one or more of the waveguide members 201, 202 or 203 or other similar modular waveguide members may be provided on the collar 26. Further, insofar as the waveguide may have different abilities to polarize light passing therethrough, such a waveguide may be used with either an emitter of polarized light or a sensor sensitive to polarized light.

The use of a plurality of different modular guide members such as 201, 202 and 203 to form the waveguide can provide a simplistic mechanism for customizing the waveguide to have selected key features.

In the preferred embodiments illustrated, for example, in FIG. 4, in combination with a suitable waveguide, there is shown both a key emitter 55 and a key sensor 56. It is not necessary in accordance with the present invention that a key emitter 55 be provided. The electromagnetic radiation to pass through the waveguide and be sensed by the key sensor may originate from an external light source such as, for example, the ambient light in any environment, for example, ambient light from lighting within a washroom or natural sunlight. For example, as seen in FIG. 1, the front portion of the shroud 16 indicated as 220 in FIG. 1 could be provided to transmit electromagnetic radiation therethrough which may impinge on a frontmost surface 221 of the collar 26 as shown in FIG. 2 which could be flattened and directed forwardly so as to provide an entry point for light into the waveguide contained in the collar. In this case, merely the radiation sensor 56 need be provided.

Alternatively, entrance for ambient air to the waveguide could be provided at the sides or bottom of the waveguide through a suitable face in the waveguide disposed to permit entry into the wave guide of electromagnetic radiation from an external source. As another example, in the context of FIG. 2, the bottle and fluid within the bottle 22 may be provided to be electromagnetic radiation transmitting with light to pass downwardly through the bottle 22 through the lower shoulder 192 and down onto an upwardly directed surface of the collar 26. The waveguide may then comprise the walls and shoulder of the bottle 22, the fluid in the bottle as well as the collar 26. Suitable selection of the radiation transmission properties therefore of the bottle walls and bottom and the fluid to be dispensed can be utilized in establishing pre-selected keying features.

Insofar as light may pass downwardly through the shoulder 192 in the bottle 22 to the collar 26, it would be possible to incorporate a component of the pump assembly such as a radially outwardly extending flange of the piston chamber-forming member 30 as being part of the waveguide and in such an event, the waveguide might incorporate a path downwardly through the shoulder 192 of the bottle past or through the support plate 18 and axially through the outer flange 31 of the piston chamber-forming member 30 as to a portion of the waveguide as to a sensor disposed axially below the outer flange 31. Preferably, the waveguide would be at least partially through the collar 26 at some portion such as axially through the collar or radially outwardly through a portion of the collar 26 which would serve as a waveguide to couple light from the outer flange 31 to a sensor carried on the activation unit 12.

Rather than use ambient light to pass through portions of the bottle and/or fluid in the bottle, a separate emitter could be provided as, for example, to pass radiation downwardly or sideways or otherwise which would pass through a portion of the bottle and/or the fluid in the bottle to be received by a sensor.

As to the nature of electromagnetic radiation to be used, many conventionally available sensors and/or emitters are available for use in emitting and sensing electromagnetic radiation in the visible light spectrum. This is not necessary, however, and electromagnetic radiation outside the visible spectrum may be used. This could be advantageous as, for example, to mask the nature of any modular components which may comprise a portion of a waveguide. For example, whether or not any modular waveguide element may appear to have a visible colour such as blue, red or yellow, insofar as it is adapted for transmission of non-visible electromagnetic radiation, then the presence or absence of colour in the modular unit could assist in fooling an imitator.

Figure 21:
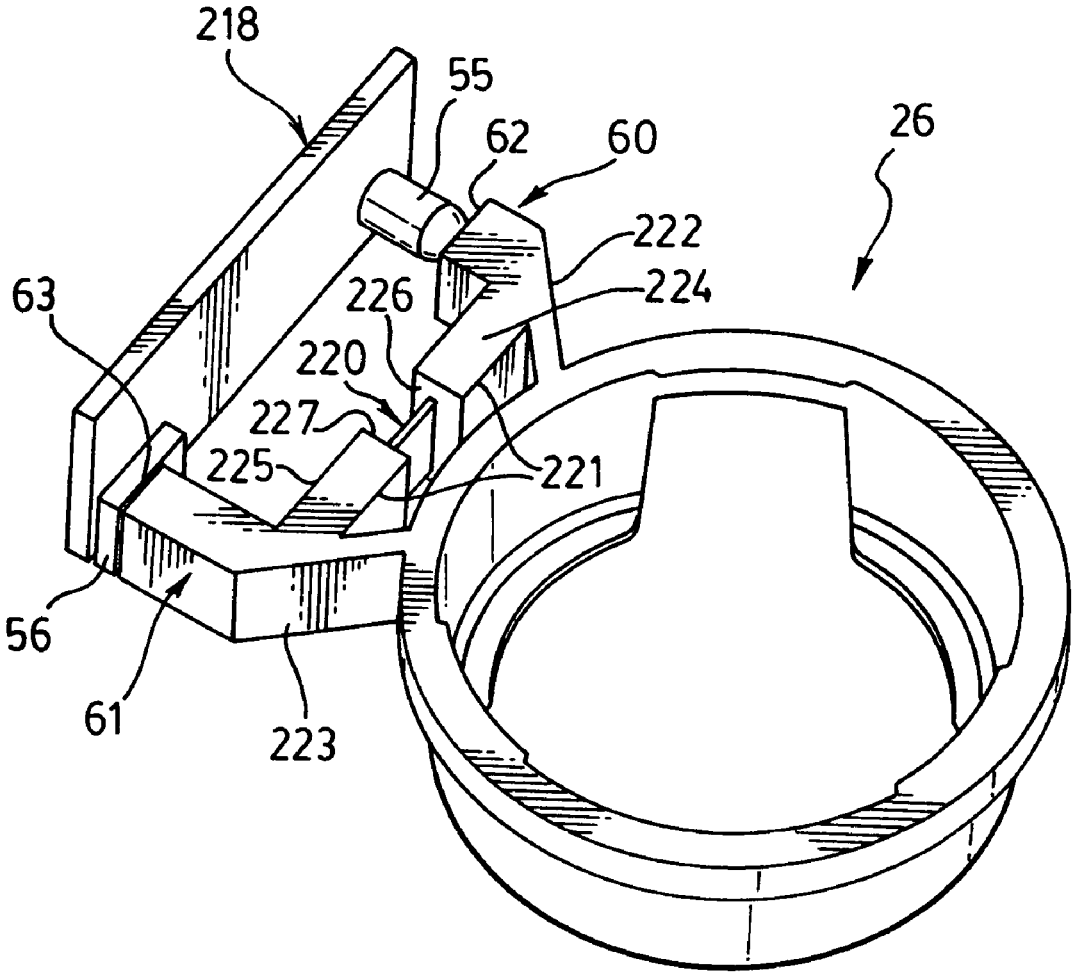
FIG. 21 shows a seventh embodiment of a collar similar to that shown in FIG. 7 and together with a board carrying a sensor and an emitter.

Reference is made to FIG. 21 showing a key collar 26 similar to that shown in FIG. 7 but for a few differences. Firstly, the lock tabs 45 of the collar 26 in FIG. 7 have been removed for simplicity in illustration. Providing such locking tabs are preferred, however, the locking tabs need not as in the context of FIG. 7 be provided on the front of the collar facing outwardly but could be provided at other locations as on the rear of the collar diametric to the position shown, for example, in FIG. 7. Secondly, as seen in FIG. 21, bridging between the arm 60 and the arm 61, there is provided a thin frangible member 220.

FIG. 21 shows in addition to the key collar 26, a separate board 218 which carries a key emitter 55 and a key sensor 56. Arm 60 includes an end face 62 normal to the key emitter 66 which face 62 is engaged by the key emitter with the end face 62 generally normal to the key emitter 55. Arm 61 includes an end face 63 which is shown as being normal to the key sensor 56 and is engaged by the key sensor. The arm 60 includes a reflecting outer side shoulder surface 222 disposed at 45 degrees to the end face 62. Arm 61 similarly includes a reflecting outer side shoulder surface 223 at 45 degrees to the end face 63. The arms 60 and 61 are joined by a bridge member 221 formed by a projection 224, the frangible member 220 and a projection 225. The arm 60 has the projection 224 extending laterally inwardly to an end face 226 disposed normal to the end face 62. The arm 61 similarly has the projection 225 extending laterally inwardly to an end face 227 normal to the end face 63 and spaced from and opposed from the end face 226. The frangible member 220 extends between the end face 226 and the end face 227 normal to each end face. The frangible member 220 has a cross-sectional area significantly less than the cross-sectional area of either of the projection 224 or the projection 225 measured parallel the end faces 226 and 227.

The frangible member 220 is preferably formed integrally with the key collar 26 as by injection moulding from plastic.

Figure 22:
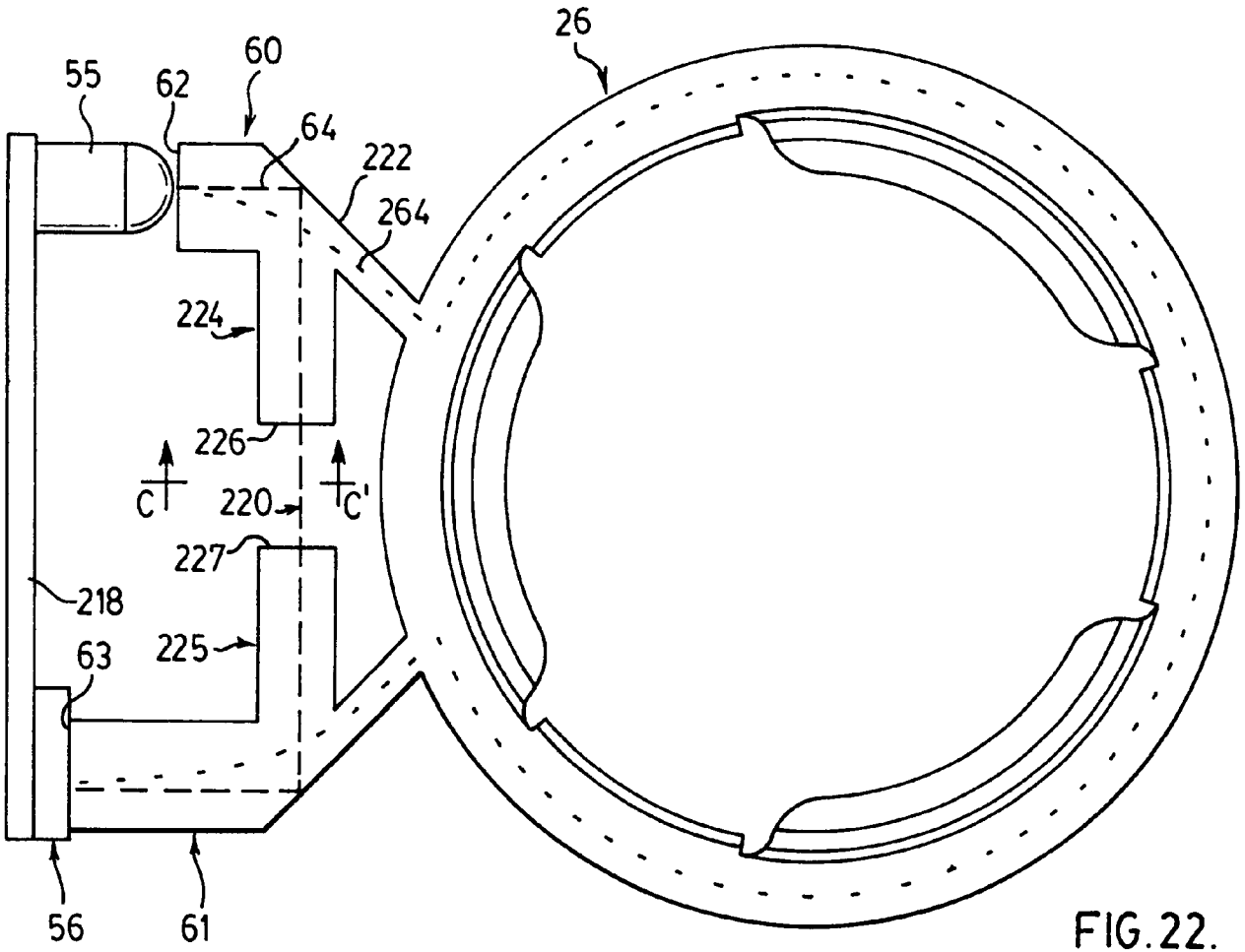
FIG. 22 shows a top view of the collar and board in FIG. 21.

FIG. 22 in top view schematically illustrates two paths that radiation may take on being transmitted through the key collar 26 from the key emitter 55 to the key sensor 56. A dashed line indicates a shorter optical path 64 in which radiation from the key emitter 55 perpendicular to the end face 62 is reflected off the shoulder surface 222 extends through the projection 224, through the frangible member 220, through the projection 225, is reflected off the shoulder surface 223 and passes through the arm 61 normal the end face 63 to be sensed by the key sensor 56. An alternate longer optical path 264 is shown in dashed lines in FIG. 22 as extending internally of the arm 60 and around the circumference of the key collar 26 and, hence, via the arm 61 to the key sensor 55.

Figure 23:
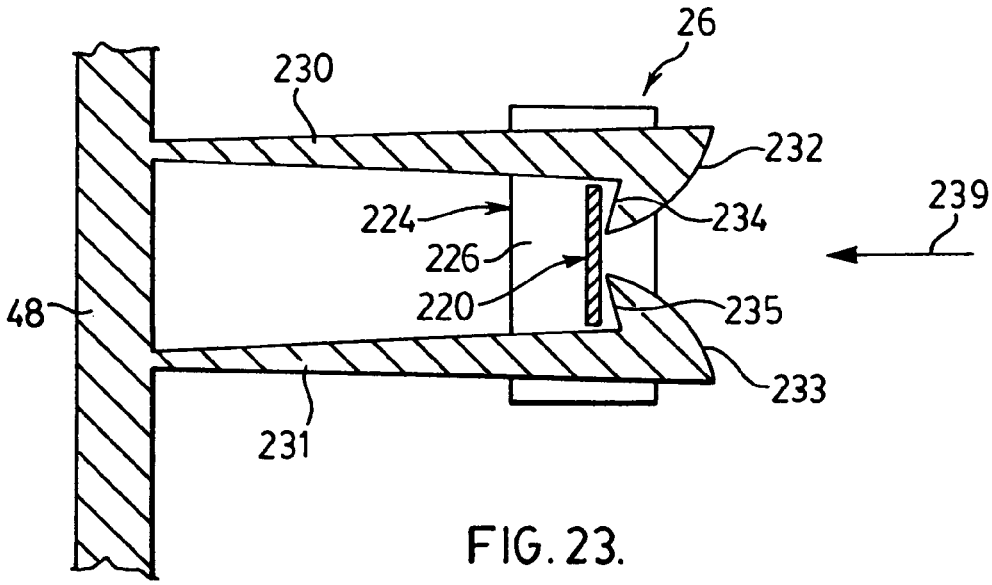
FIG. 23 schematically illustrates a cross-sectional side view along section line C-C' in FIG. 22 showing the collar in cross-section and also showing in cross-section, a schematic catch arrangement.

Reference is made to FIG. 23 which illustrates a cross-sectional side view along section C-C' in FIG. 22 through the frangible member 220 and which therefore shows the projection 224 not in cross-section. FIG. 23 schematically illustrates, as seen in cross-section, a pair of resilient catch members 230 and 231 secured to the activation unit 48 similar to the type shown in FIG. 2. Preferably, coupling of the key collar 26 to the activation unit 48 is accomplished by rearward sliding of the key collar 26 towards the activation unit 48 in a direction indicated by the arrow 239.

The two resilient catch members 230 and 231 are schematically shown in cross-section as secured to the activation unit 48. Each catch member 230 and 231 has a forwardly directed cam surface 232 and 233, respectively, which on relative rearward movement of the key collar 26 will engage the frangible member 220 and cause deflection of the resilient catch members 230 and 231 upwardly or downwardly out of the path of the frangible member 220 until the frangible member 220 is received rearward of the respective catch shoulders 234 and 235 on each of the catch members 230 and 231, whereupon the catch members 230 and 231 will under their inherent bias move to assume a latched position as shown in FIG. 23 with their catch shoulders 234 and 235 disposed forwardly of a forward surface of the frangible member 220.

With removal of the key collar 26 by forward sliding of the key collar away from the activation unit 48, the catch members 230 and 231 will engage the frangible member 220 and prevent its forward movement. The frangible member 220 is preferably of a material and has a construction which will be broken and severed under manual forces which can be readily applied in sliding the key collar 26 forwardly. As a result, with forward movement of the key collar 26 and removal of the key collar 26 from coupling with the activation unit 48, the frangible member 220 is broken and preferably severed from the key collar 26.

As a result, if the key collar 26 with the broken or removed frangible member 220 is reinserted into the dispenser, then there will no longer exist the optical path 64 for transmission of electromagnetic radiation through the frangible member 220. Thus, the electromagnetic transmission properties of the waveguide formed within the key collar 26 will have been changed by severing the frangible member 220 on removal of the key collar 26. The nature of the electromagnetic radiation sensed by the key sensor 26 will be altered and the dispenser control mechanism can give suitable instructions as to how to deal with this event as, for example, to not permit operation of the dispenser.

Figure 24:
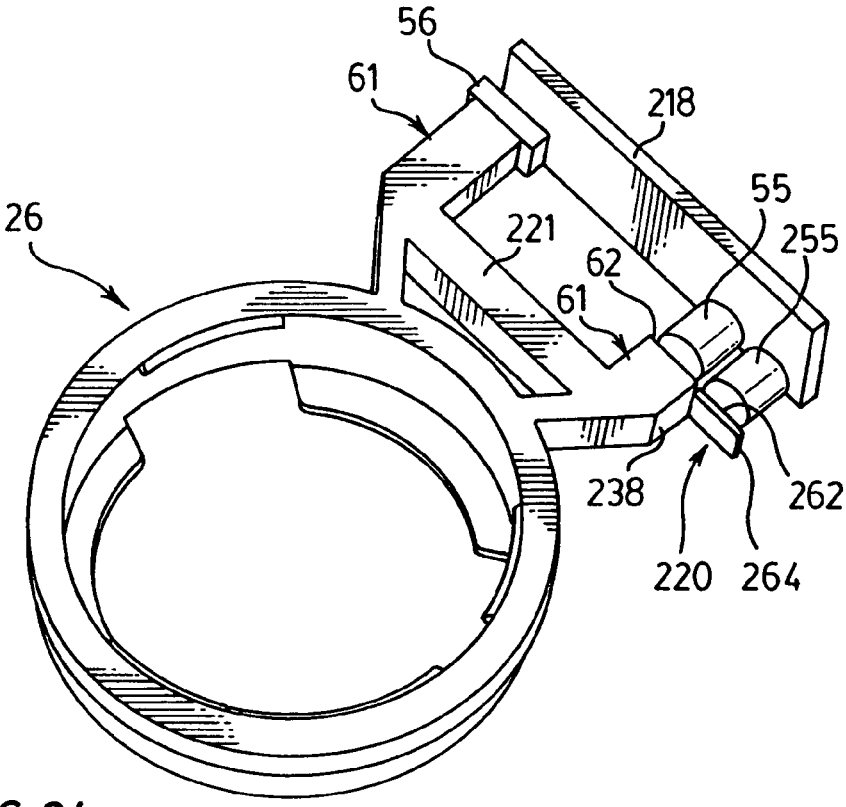
FIG. 24 shows an eight embodiment of a collar and a board carrying a sensor and an emitter similar to that shown in FIG. 21.

Reference is made to FIG. 24 which shows an eighth embodiment of the key collar 26 similar to that shown in FIG. 7 but with a few differences. Firstly, in FIG. 24, the arm 60 and the arm 61 are joined by the bridge member 221 which is of substantially constant cross-sectional area normal to the end faces 62 and 63 between the two arms 60 and 61.

Secondly, extending laterally from outside surface 238 of the arm 61, there is provided a cantilevered frangible member 220 having but one end secured to the arm 60. The frangible member 220 has a cross-sectional area normal to the end face 62 of the arm 61 which is significantly reduced compared to that of the arm 60.

As contrasted with the embodiment of FIG. 21, in FIG. 24, two key emitters are provided, a first key emitter 55 and a second parallel key emitter 255. The first key emitter 55 is disposed to direct radiation into the end face 62 of the arm 60. The second key emitter 255 is located to engage a surface 262 on the frangible member 220 and to direct radiation into the frangible member 220. The key sensor 56 engages the end face 63 of the arm 61. In the embodiment of FIG. 24, the frangible member 220 is adapted to be severed from or removed from the key collar 26 on removal of the key collar 26 from the dispenser.

While the frangible member 220 is coupled to the key collar 26 as shown in FIG. 24, then electromagnetic radiation from the second key emitter 255 will enter the waveguide via the frangible member 220 and will be picked up by the key sensor 56. However, insofar as a key collar is coupled on which the frangible member 220 has been severed from the key collar, then the key sensor 56 will not pick up radiation from the second emitter 255. While two key emitters 56 and 256 are provided, only the key emitter 255 is needed to sense the removal of the frangible member 220.

The frangible member 220 in FIG. 24 need not be severed from the key collar 26, rather, it may be bent forwardly into, for example, assume a position bent away from the second key emitter 256 as, for example, to a 45 degrees position and would result in a significant change in the waveguide transmission characteristic such that radiation from the second key emitter 255 would be significantly lessened to the extent it may enter the waveguide and thus be sensed by the key sensor 56.

In FIG. 24, the radiation is directed into the frangible member via the surface 262 which is in the same plane as end face 62 on the arm 60. Alternatively, the key emitter 255 may direct radiation into the frangible member 220 at another location as, for example, at a lateral side surface 264 of the frangible member 220, with the sensor 256 suitably re-positioned.

FIG. 24 shows the use of a plurality of key emitters 55 and 255 and one key sensor 56. Of course, in a similar arrangement, one or more key sensors could be used with at least one key sensor coupled to the frangible member 220 and one key emitter to input radiation to arm 61.

Referring to FIG. 25, a reservoir bottle 22 is shown which is similar to the reservoir bottle 22 shown in FIGS. 1 to 5. As a notable difference, however, the reservoir bottle 22 in FIG. 25 carries as extending downwardly from its lower edge, a frangible member 220 which is in the form of a relatively thin plate member formed integrally with the reservoir bottle 22 as, for example, from plastic material and which is adapted to serve as a portion of a waveguide. The frangible member 22 is adapted on rearward sliding insertion of the bottle 22 to slide rearwardly so as to be received between a key emitter 355 and a key sensor 356 as schematically illustrated in a horizontal cross-section in FIG. 26. The frangible member 220 is adapted to be severed or removed on removal of the reservoir bottle 22. The frangible member 220 on the reservoir bottle 22 is to serve as a portion of a waveguide. The frangible member 220 on the bottle 22 may be in substitution of the key collar 26 and its waveguide as in the other embodiments or in combination therewith.

Frangible members 220 have been shown as coupled to the reservoir bottle 22 in FIG. 25 and to the key collar 26 as in FIGS. 21 and 24. Similar frangible members forming part of a waveguide may be coupled to the pump assembly as preferably to the piston chamber forming member 30.

The particular nature of the frangible member 220 may vary widely. The objective is to provide an arrangement such that with insertion or removal of a removable component, comprising in the case of the preferred embodiment the reservoir assembly 12, a portion of a waveguide carried by the removable reservoir assembly 12 becomes changed such that a control system can recognize a reservoir assembly 12 which has been coupled or uncoupled more than once and make an appropriate selection as to how to deal with this in control of the dispenser as one example, when the control system recognizes that a reservoir assembly has been coupled or uncoupled more than once then the control system may prevent dispensing of the material.

As another example, when the control system recognizes that a reservoir assembly has been coupled or uncoupled more than once, then the control system may merely permit thereafter a given number of activations of the piston pump after which the control system will prevent dispensing. In the context of the embodiment in FIG. 24 there are two distinct optical paths, a first optical paths between key emitter 55 and key sensor 56 and a second optical path between key emitter and 255 and key sensor 56. The possibilities for the control system sensing include the following:

A: Double Positive—meaning sensing of electromagnetic radiation through the first optical path and sensing electromagnetic radiation through the second optical path;

B: Double Negative—meaning no sensing of electromagnetic radiation through the first optical path and no sensing electromagnetic radiation through the second optical path;

C: First Positive/Second Negative—meaning sensing of electromagnetic radiation through the first optical path and no sensing of electromagnetic radiation through the second optical path; and D: First Negative/Second Positive—meaning no sensing of electromagnetic radiation through the first optical path and sensing of electromagnetic radiation through the second optical path.

A first rule of operation for the control system preferably is that operation is only permitted when the control system senses passage of electromagnetic radiation through the first optical path, that is there is either (A) Double Positive or (C) First Positive/Second Negative.

A counter mechanism for the control system is to count activation of the piston 32 when there is electromagnetic radiation through the first optical path thus, under either condition (A) double positive or condition (C) First Positive/Second Negative. A second rule of operation is preferably is that after a maximum number of activations have been counted since the last resetting of the counter mechanism that operation of the pump is prevented. The maximum number of operations can be selected having regard to the volume of the fluid in any reservoir assembly which has been applied and the volume of dosage that is the amount of liquid which is to be dispensed by the piston 32 in a typical activation. If, for example, the reservoir assembly is a 1 liter and the dosage volume is 1 ml then a maximum number of activation could be selected to be, for example, 1000 activations, however, preferably there will be some buffer for inaccuracy of strokes, for example, an additional 5 percent to 25 percent thus representing, for example, as a maximum being selected between preferably 1050 and 1250 activations.

The count preferably may be reset to zero at a time when in sequence the control system after sensing no radiation through the first optical path, that is either condition (B) double negative or condition (D) First Negative/Second Positive the senses (A) Double Positive. This is equivalent to a situation in which the reservoir assembly is removed such that (B) the Double Negative is sensed and then a new reservoir assembly with its fragile member 220 in tact is applied, in which case the reservoir assembly would be expected to have its reservoir is filled of fluid and it is reasonable to reset the counter to zero and permit in the normal course operation of the dispenser for dispensing of all of the fluid from the reservoir, stopping operation however preferably if more than a maximum activations have been carried out as reasonably necessary to empty the reservoir. Having the maximum number of activations used to stop operation when there has been a continuous double positive is not necessary but preferred.

From a condition in which the counter mechanism is counting, if the reservoir assembly is then removed, condition B a Double Negative would be sensed. If the same reservoir assembly is removed and then recoupled, such reservoir assembly will not have the frangible member 220 attached. On recoupling, there will be a sensing of condition C being First Positive and Second Negative. On such sensing, the control system will not restart the counter to zero but will continue with the same count. This permits a reservoir assembly which has been removed and recoupled to continue to be dispensed, however, only to the maximum number of activations. The same reservoir assembly may thus be removed and recoupled a number of times with a counter mechanism continuing to count and operation being permitted until such time as the maximum number of activations has arisen.

If after removal of a reservoir assembly, a reservoir assembly is coupled which does not include either the first optical path or the second optical path then the condition (B) the double negative arises and no dispensing is permitted. Similarly, if a reservoir assembly might be applied which provides condition (D) of a First Negative and a second positive, then no dispensing arises.

Whether or not the counter mechanism may be operative such that it will stop dispensing during the condition (A) of continuous Double Positive when a mechanism is reached arises, it is preferred that when condition (C) arises with First Positive and Second Negative that the counter mechanism stop dispensing when the maximum number of activations have been reached.

The counter mechanism may have a separate total count function which counts the number of activations of the piston irrespective of whether or not anyone of the conditions A, B, C or D are present as, for example, to provide an indication of the life and overall usage of the dispenser. Of course, the counter mechanism and the maximum for each counter mechanism may be varied depending upon the volume of the reservoir, the nature of the fluid to be dispensed, the size and or stroke of the piston as would be appropriate. As well, the maximums of counter mechanism may be selected so as to ensure that all of the fluid is dispensed or to ensure that activations is stopped before all the fluid may be dispensed from the reservoir.

The present invention teaches the use of a dual key system in which two key systems are sensed to control operation of the dispenser. The preferred embodiments teach that both key systems are optical systems. However this is not necessary and the present invention includes a dual key system where one or both of the key systems are not optical but rather are another type of keying system. Such other types of key systems can include mechanical, magnetic, radio frequency, optical scanner, electrical and capacitor based systems including one or more of such key systems used in combination with each other and with optical key systems. For example, in the context of FIGS. 25 and 24, the elements indicated 255 and 355 can comprise merely a capacitor which senses the present or absence of the frangible element 22. As another alternative, the frangible element 220 may carry a magnet such as in a form of a magnetic strip and the elements 255 and 355 may comprise a magnetic detector. The frangible element 220 might carry a machine readable optical representation such as a bar code or universal product code and the elements 255 and 355 may comprise an optical reader such as a bar code reader. The frangible element 220 may carry radio-frequency identification (RFID) tag or transponder, whether passive, active or semi-active to be sensed by the element 255 and 355 being a complimentary sensory.

Carrying a secondary keying system on the removable reservoir assembly for alteration of the secondary keying system on coupling or uncoupling of the removable reservoir assembly provides in the context of the operation described with reference to FIG. 24, an improved control of the operation of a dispenser permitting as described above, amongst other things, the permitted coupling and recoupling of the same reservoir assembly to the dispenser for dispensing to a maximum number of actuations of the pump as described above. The use of such a frangible member whether optical, magnetic, a RFID tag or a bar code or otherwise could be used not only with the primary keying system disclosed in the present application as being optical but also with other keying systems such as that described in U.S. patent publication US2006/0124662 to Reynolds et al., using an electric coil/capacitor type system. An optical key system is preferred as in the proposed preferred embodiments in that all of the components of the optical key system on the removable reservoir assembly may be conveniently made from plastic as by injection moulding.

As to the change of the characteristics of a waveguide on coupling of the removable reservoir assembly 12 to the dispenser, it is possible that selected frangible portions on the reservoir assembly 12 be removed on coupling or insertion rather than on removal. It is not necessary that the waveguide be changed by removal or severing of a frangible member. A portion of the removable reservoir assembly 12 which comprises a portion of the waveguide may be bended or deflected or otherwise manipulated in a manner so that they can come to be suitably positioned relative to a key emitter or a key sensor on coupling yet on removal or reinsertion would not adopt the same physical configuration.

It may be possible for unauthorized tampering of a device in accordance with the present invention as by the removal of the catch mechanism such as the catch members 230 and 231 shown in FIG. 23 to prevent the severance of frangible member 220 so that the reservoir assembly 12 could be reused. Alternatively, after severing of frangible member 220 from reservoir assembly 12, efforts could be made to secure a frangible member in an appropriate location towards possibly having the wave path appear unchanged. Methods for overcoming such tampering include having a control mechanism count the number of activations to calculate when a reservoir assembly 12 may be considered to have its reservoir bottle empty and preventing operation after the reservoir bottle 22 is perceived to be empty as by not permitting use until the controller sees that there is a removal and replacement of the key member as in the sensing of the absence of a frangible member followed by the sensing of the presence of a frangible member. This arrangement may, for example, require the provision of additional key emitters, key sensors and members through which an optical path is sensed. The removal of the catch members 230 or 231 could be prevented by their physical location and/or by requiring some test by a control system to ensure that, in fact, the catch members may be intact.

In the preferred embodiment illustrated in FIG. 1, the reservoir assembly 12 is removable as by moving vertically downward and then being slid rearwardly. It is to be appreciated that with various arrangements, the reservoir assembly 12 could be coupled to the remainder of the dispenser merely by moving vertically downwardly or merely sliding in one direction as, for example, horizontally or at an angle downwardly and rearwardly. Of course, in the preferred embodiments shown, the vertical opening through the support plate 18 is to be sized to permit the lower end of the reservoir assembly 12 including the key collar 26 to be moved downwardly therethrough before being slid rearwardly.

In the preferred embodiments illustrated, the optical sensor or emitters are shown as substantially in contact with the waveguide through which electromagnetic radiation is to be transferred. This is preferred but not necessary as light will transfer through air and can assist in the relative location of the various sensors and emitters and the entrances and exits of the waveguides.

While the invention has been described with reference to preferred embodiments, many modifications and variations will now occur to persons skilled in the art. For a definition of the invention, reference is made to the following claims.

We claim:

1. A method of controlling operation of a mechanism having a removable component removably coupled thereto, comprising the steps of:

measuring electromagnetic radiation passing through a plurality of waveguides carried on a removable, replaceable component, and permitting operation of the mechanism only when measured electromagnetic radiation passing through two or more waveguides complies with one or more pre-selected output parameters, the removable component has a plurality of waveguides, and the method including measuring the electromagnetic radiation passing through two or more of said waveguides, and preventing operation of the mechanism when the measured electromagnetic radiation of a first of the waveguides does not comply with the pre-selected output parameters for the first waveguide and the measured electromagnetic radiation of a second of the waveguides does not comply with the pre-selected output parameters for the second waveguide.

2. A method as claimed in claim 1 wherein the mechanism is a dispensing mechanism and the removable component is selected from one or more of a reservoir containing the material to be dispensed and an element of a pump mechanism required for dispensing the material to be dispensed.

3. A method as claimed in claim 2 wherein each waveguide has an entrance and an outlet, and further including the steps of:

measuring the electromagnetic radiation passing through each waveguide by emitting electromagnetic radiation from an electromagnetic radiation emitter, directing the electromagnetic radiation into the entrance of said each waveguide, and sensing electromagnetic radiation exiting from the outlet of said each waveguide.

4. A method as claimed in claim 3 wherein the method further including the steps of:

coupling of the removable component to the dispensing mechanism and subsequent removal of the removable component from the dispensing mechanism as for replacement by another removable component, and wherein the coupling of the removable component to the dispensing mechanism or the removal of the of the removable component from the dispensing mechanism changes a transmission characteristic of one of the waveguides carried on the removable component are such that if the removable component after being changed is removed from and then re-coupled to the dispensing mechanism, the measured radiation for the one said waveguide would not comply with at least one of the pre-selected output parameters for the one said waveguide.

5. A method as claimed in claim 4 wherein one of the waveguides carried on the removable component comprises a frangible portion which on breaking changes a transmission characteristic of said one waveguide, and the method including the step of severing the frangible portion on removing the removable component from the dispensing mechanism.

6. A method as claimed in claim 1 wherein:

the removable component comprises the reservoir containing material to be dispensed, the reservoir having an outlet opening for dispensing of the material therefrom, an outlet member secured to the outlet opening substantially against removal from the reservoir, the outlet member when secured to the reservoir rendering the reservoir difficult to refill with the material through the outlet opening, and the reservoir aside from the outlet opening not having another opening via which material can be passed except with difficulty to refill the reservoir with the material.

7. A method as claimed in claim 1 including:

counting of each activation of a pump mechanism dispensing an allotment of a material to be dispensed, resetting counting to zero after a removal of the removable component and its replacement with a removable component whose measured electromagnetic radiation of a first of the waveguides complies with the pre-selected output parameters of the first waveguide and the measured electromagnetic radiation of a second of the waveguides complies with the pre-selected output parameters for the second waveguide, and permitting operation of the dispenser after the removal of the removable component and its replacement with a removable component whose measured electromagnetic radiation of the first waveguide complies with pre-selected output parameters of the first waveguide and the measured electromagnetic radiation of the second waveguide does not comply with the pre-selected output parameters of the second waveguide but only until a number of activations of the pump mechanism from a last restart exceeds a pre-selected maximum number of activations.

8. A method as claimed in claim 2 wherein the method further including the steps of:

coupling of the removable component to the dispensing mechanism and subsequent removal of the removable component from the dispensing mechanism as for replacement by another removable component, and wherein the coupling of the removable component to the dispensing mechanism or the removal of the of the removable component from the dispensing mechanism changes a transmission characteristic of one of the waveguides carried on the removable component are such that if the removable component after being changed is removed from and then re-coupled to the dispensing mechanism, the measured radiation for the one said waveguide would not comply with said one or more pre-selected output parameters.

9. A method as claimed in claim 4 wherein:

the removable component comprises the reservoir containing the material to be dispensed, the reservoir having an outlet opening for dispensing of the material therefrom, an outlet member secured to the outlet opening substantially against removal from the reservoir, the outlet member when secured to the reservoir rendering the reservoir difficult to refill with the material through the outlet opening, and the reservoir aside from the outlet opening not having another opening via which the material can be passed except with difficulty to refill the reservoir with the material.

10. A method as claimed in claim 3 wherein the emitted electromagnetic radiation complies with one or more pre-selected input parameters.

11. A method as claimed in claim 3 including emitting a plurality of emissions of electromagnetic radiation at different times and simultaneously with each respective emission sensing for corresponding electromagnetic radiation exiting from the outlet of at least one of the waveguides.

12. A dispensing system comprising:

a reservoir assembly including a reservoir containing material to be dispensed and an activation unit, the reservoir assembly removably coupled to the activation unit for replacement by a similar reservoir assembly, a plurality of electromagnetic radiation waveguides, each having an inlet and an outlet and providing a path for transmission of electromagnetic radiation from the inlet to the outlet, an electromagnetic radiation sensor carried by the activation unit sensing electromagnetic radiation from each waveguide via its respective outlet, at least part of one of the waveguides carried by the reservoir assembly and removable therewith, and a control mechanism to determine if the electromagnetic radiation sensed by the sensor for each waveguide appropriately correlates to a pre-selected electromagnetic radiation profile for each waveguide, the control mechanism preventing operation of the dispensing system from dispensing the material when the measured electromagnetic radiation of a first of the waveguides does not comply with the pre-selected radiation profile of the first of the waveguides and the measured electromagnetic radiation of a second of the waveguides does not comply with the pre-selected radiation profile of the second of the waveguides.

13. A dispensing system as claimed in claim 12 further comprising:

an electromagnetic radiation emitter carried by the activation unit directing electromagnetic radiation into said each waveguide via the inlet, and wherein the pre-selected electromagnetic radiation profile for said each waveguide correlates to the electromagnetic radiation emitted by the emitter.

14. A dispensing system as claimed in claim 13 wherein the reservoir having an outlet opening for dispensing of the material therefrom, an outlet member secured to the outlet opening substantially against removal from the reservoir the outlet member when secured to the reservoir rendering the reservoir difficult to refill with the material through the outlet opening, the reservoir aside from the outlet opening not having another opening via which material can be passed except with difficulty to refill the reservoir with the material, and removal of the outlet member causing destruction of a portion of one of the waveguides which changes a transmission characteristic of the electromagnetic radiation of said one of the waveguides from the inlet to the outlet via the path.

15. A dispensing system as claimed in claim 14 wherein the outlet member includes a pump mechanism activatable by the activation unit to dispense the material from the reservoir out of the outlet opening.

16. A dispensing system as claimed in claim 12 wherein the first of the waveguides includes a frangible portion comprising a portion of the path, which said frangible portion if broken changes a transmission characteristic of that waveguide such that the electromagnetic radiation sensed by the sensor from that said waveguide will not appropriately correlate to the pre-selected electromagnetic radiation profile for that waveguide, and wherein removal of the reservoir assembly from the activation unit breaks the frangible portion.

17. A dispensing system as claimed in claim 15 wherein one of the waveguides includes a frangible portion comprising a portion of the path, which said frangible portion if broken changes a transmission characteristic of said one waveguide such that the electromagnetic radiation sensed by the sensor will not appropriately correlate to the pre-selected electromagnetic radiation profile of said one waveguide, and wherein removal of the reservoir from the activation unit breaks the frangible portion.

18. A method of controlling operation of a dispensing mechanism having a removable component removably coupled thereto, the removable component including a reservoir containing a volume of material to be dispensed, the method comprising the steps of:

determining if a removable, replaceable component has a first keying attribute which complies with a first pre-selected attribute and has a second keying attribute which complies with a second pre-selected attribute, preventing operation of the dispensing mechanism with the removable, replaceable component which does not have the first keying attribute which complies with the first pre-selected attribute and does not have the second keying attribute which complies with the second pre-selected attribute, estimating the volume of material dispensed by counting activation of a pump mechanism dispensing the material to be dispensed, resetting said counting to zero after the removal of the removable component and its replacement with a removable component which has the first keying attribute which complies with the first pre-selected attribute and has the second keying attribute which complies with the second pre-selected attribute, and permitting operation of the dispensing mechanism after the removal of the removable component and its replacement with a removable component which has the first keying attribute which complies with the first pre-selected attribute and does not have the second keying attribute which complies with the second pre-selected attribute but only until an estimate of the volume of material dispensed by counting approximates a volume representative of a volume of the reservoir.

* * * * *